US012606333B2

(12) United States Patent
Keller et al.

(10) Patent No.: US 12,606,333 B2
(45) Date of Patent: Apr. 21, 2026

(54) STRAPPING TOOL

(71) Applicant: SIGNODE INDUSTRIAL GROUP LLC, Glenview, IL (US)

(72) Inventors: Andreas Keller, Birr (CH); Guido Leine, Koetinchem (NL); Kurt Bolliger, Ehrendingen (CH); Michael Wettstein, Lenzburg (CH); Samuel Hochstrasser, Fallanden (CH); Mirco Neeser, Ehrendingen (CH)

(73) Assignee: Signode Industrial Group LLC, Tampa, FL (US)

( * ) Notice: Subject to any disclaimer, the term of this patent is extended or adjusted under 35 U.S.C. 154(b) by 467 days.

(21) Appl. No.: 17/450,880

(22) Filed: Oct. 14, 2021

(65) Prior Publication Data

US 2022/0063850 A1 Mar. 3, 2022

Related U.S. Application Data

(63) Continuation of application No. 16/852,797, filed on Apr. 20, 2020, now Pat. No. 11,352,153.

(60) Provisional application No. 62/907,248, filed on Sep. 27, 2019, provisional application No. 62/844,389, filed on May 7, 2019.

(51) Int. Cl.
*B65B 13/02* (2006.01)
*B65B 13/34* (2006.01)

(52) U.S. Cl.
CPC ..... *B65B 13/027* (2013.01); *B65B 13/34* (2013.01)

(58) Field of Classification Search
CPC ..... B65B 13/34; B65B 13/345; B65B 13/185; B65B 13/30; B65B 13/305
USPC ..... 100/30, 33 R, 33 PB; 140/93.4, 150, 152
See application file for complete search history.

(56) References Cited

U.S. PATENT DOCUMENTS

| | | | | |
|---|---|---|---|---|
| 1,891,239 | A | 12/1932 | Ekern | |
| 1,984,652 | A | 12/1934 | Ekern | |
| 2,040,576 | A | 5/1936 | Erich | |
| 2,076,276 | A | 4/1937 | Porter | |
| 2,257,090 | A * | 9/1941 | Childress | B65B 13/345 140/152 |
| 2,336,264 | A | 12/1943 | Leslie, II | |
| 2,661,030 | A | 12/1953 | Crosby et al. | |
| 2,801,558 | A | 8/1957 | Crosby et al. | |

(Continued)

FOREIGN PATENT DOCUMENTS

| | | | |
|---|---|---|---|
| BR | 112014014798 | A2 | 6/2017 |
| BR | 112014015409 | A2 | 6/2017 |

(Continued)

OTHER PUBLICATIONS

Desmondttm123,https://forum.arduino.cc/t/convert-a-rotational-motor-to-a-linear-motor/163939 (Year: 2013).*

(Continued)

*Primary Examiner* — Bobby Yeonjin Kim
(74) *Attorney, Agent, or Firm* — Neal, Gerber & Eisenberg LLP

(57) ABSTRACT

Various embodiments of the present disclosure provide a strapping tool configured to tension metal strap around a load and, after tensioning, attach overlapping portions of the strap to one another by cutting notches into a seal element positioned around the overlapping portions of the strap and into the overlapping portions of the strap themselves.

16 Claims, 34 Drawing Sheets

(56) References Cited

U.S. PATENT DOCUMENTS

| | | | | |
|---|---|---|---|---|
| 2,915,003 | A | 12/1959 | Crosby et al. | |
| 2,936,156 | A | 5/1960 | Coupland | |
| 2,941,782 | A * | 6/1960 | Winkler | B65B 13/345 294/135 |
| 2,986,376 | A | 5/1961 | Falck-pedersen | |
| 3,028,885 | A | 4/1962 | Leslie et al. | |
| 3,032,075 | A | 5/1962 | Hall et al. | |
| 3,103,955 | A | 9/1963 | Ericsson et al. | |
| 3,150,694 | A | 9/1964 | Meier | |
| 3,211,186 | A | 10/1965 | Harold | |
| 3,284,049 | A | 11/1966 | Haraden | |
| 3,319,666 | A | 5/1967 | Victor et al. | |
| 3,396,760 | A | 8/1968 | Peter et al. | |
| 3,506,041 | A | 4/1970 | Angarola | |
| 3,586,572 | A | 6/1971 | Ericsson | |
| 3,654,033 | A | 4/1972 | Angarola et al. | |
| 3,718,526 | A | 2/1973 | Annis | |
| 3,769,859 | A | 11/1973 | Sykes et al. | |
| 3,863,684 | A | 2/1975 | Simmons | |
| 4,015,643 | A | 4/1977 | Cheung | |
| 4,245,678 | A | 1/1981 | Sansum | |
| 4,282,907 | A | 8/1981 | Massion et al. | |
| 4,313,779 | A | 2/1982 | Nix | |
| 4,356,845 | A | 11/1982 | Kimbrough | |
| 4,488,926 | A | 12/1984 | Rauch et al. | |
| 5,078,185 | A | 1/1992 | Angarola | |
| 5,653,095 | A | 8/1997 | Stamm | |
| 6,308,760 | B1 | 10/2001 | Finzo et al. | |
| 6,328,087 | B1 | 12/2001 | Finzo et al. | |
| 6,338,375 | B1 | 1/2002 | Harada | |
| 6,422,272 | B1 | 7/2002 | Crittenden | |
| 6,578,337 | B2 | 6/2003 | Scholl et al. | |
| 6,895,733 | B2 | 5/2005 | Nix | |
| 6,918,235 | B2 | 7/2005 | Nix | |
| 7,073,431 | B1 | 7/2006 | Chen | |
| 7,089,970 | B2 | 8/2006 | Bernard | |
| 7,155,885 | B1 | 1/2007 | Nasiatka et al. | |
| 7,497,068 | B2 | 3/2009 | Nasiatka et al. | |
| 9,085,070 | B2 | 7/2015 | Skonieczy et al. | |
| 9,272,799 | B2 * | 3/2016 | Figiel | B65B 13/305 |
| 9,346,572 | B2 | 5/2016 | Leppert | |
| 9,403,609 | B2 | 8/2016 | Bonifazi et al. | |
| 9,468,968 | B2 | 10/2016 | Figiel et al. | |
| 9,630,265 | B2 | 4/2017 | Figiel et al. | |
| 10,183,769 | B2 | 1/2019 | Figiel et al. | |
| 10,308,383 | B2 | 6/2019 | Boss et al. | |
| 10,322,831 | B2 | 6/2019 | Nasiatka et al. | |
| 10,577,137 | B2 | 3/2020 | Nasiatka et al. | |
| 10,745,158 | B2 | 8/2020 | Sikora et al. | |
| 10,882,649 | B2 | 1/2021 | Rauch | |
| 11,111,039 | B2 | 9/2021 | Yang | |
| 11,130,598 | B2 | 9/2021 | Sikora et al. | |
| 11,174,051 | B2 | 11/2021 | Graef et al. | |
| 2003/0230058 | A1 | 12/2003 | Nix | |
| 2005/0000586 | A1 | 1/2005 | Zeimetz et al. | |
| 2011/0056390 | A1 | 3/2011 | Neeser et al. | |
| 2011/0056391 | A1 | 3/2011 | Neeser et al. | |
| 2011/0056392 | A1 | 3/2011 | Neeser et al. | |
| 2012/0210682 | A1 | 8/2012 | Gardner et al. | |
| 2014/0083311 | A1 | 3/2014 | Bonifazi et al. | |
| 2014/0290179 | A1 | 10/2014 | Keller | |
| 2015/0246739 | A1 | 9/2015 | Finzo et al. | |
| 2015/0321777 | A1 * | 11/2015 | Nasiatka | B65B 13/345 53/399 |
| 2016/0107775 | A1 | 4/2016 | Amacker et al. | |
| 2016/0376041 | A1 | 12/2016 | Skonieczny, Jr. et al. | |
| 2017/0166335 | A1 | 6/2017 | Nasiatka et al. | |
| 2017/0174374 | A1 | 6/2017 | Figiel et al. | |
| 2018/0054033 | A1 | 2/2018 | Skonieczny et al. | |
| 2018/0127124 | A1 * | 5/2018 | Sikora | B65B 57/00 |
| 2019/0256233 | A1 | 8/2019 | Sikora et al. | |
| 2020/0339289 | A1 | 10/2020 | Finzo | |
| 2020/0339290 | A1 | 10/2020 | Finzo | |
| 2020/0377245 | A1 | 12/2020 | Sikora et al. | |

FOREIGN PATENT DOCUMENTS

| | | | |
|---|---|---|---|
| CN | 1388040 | A | 1/2003 |
| CN | 201102638 | Y | 8/2008 |
| CN | 101391661 | B | 6/2011 |
| CN | 102256875 | A | 11/2011 |
| DE | 929114 | C | 6/1955 |
| DE | 1185532 | B | 1/1965 |
| DE | 29507452.3 | U1 | 7/1995 |
| DE | 102009016302 | A1 | 10/2010 |
| EP | 0703146 | A1 | 3/1996 |
| EP | 1413519 | A1 | 4/2004 |
| EP | 1582463 | A2 | 10/2005 |
| EP | 3272659 | A1 | 1/2018 |
| EP | 3696102 | A1 | 8/2020 |
| EP | 3696103 | A1 | 8/2020 |
| GB | 671316 | A | 4/1952 |
| GB | 896398 | A | 5/1962 |
| TW | M258045 | U | 3/2005 |

OTHER PUBLICATIONS

"First Chinese Office Action and Search Report", with English translation corresponding to Chinese Patent Application No. 202080032926.2, Aug. 24, 2022.

"International Search Report and Written Opinion", Corresponding PCT Application No. PCT/US2020/029207 (20 pages), Oct. 16, 2020.

"Taiwan First Office Action", corresponding Taiwan Patent Application No. 109114995, with English translation (16 pages), May 24, 2021.

"Operating Instructions STR 64 Pneumatic Hand Tool for Steel Strapping", Orgapack GmbH, publicly available before the priority date of the present application.

"Operation, Parts and Safety Manual PNSC-2 Pneumatic Combination Strapping Tool", Signode, publicly available before the priority date of the present application.

"Operation, Parts and Safety Manual RCNS2-34 RCNS2-114 Pistol-Grip Style Air Powered Sealers", Signode Engineered Products, publicly available before the priority date of the present application.

"First Office Action", Translation, from corresponding Taiwan Patent Application No. 109114995, Nov. 10, 2021.

"Extended European Search Report", corresponding European Patent Application No. 21 20 6003.2, Feb. 17, 2022.

"First Examination Report", corresponding India Patent Application No. 202117049124, Feb. 28, 2022.

"Notification of Reasons for Refusal", corresponding Republic of Korea Patent Application No. 10-201-7035197, Feb. 16, 2023.

CB 130 Hand Tool for PP/PET Strapping Service For Internal Use Only, Cyklop GmbH, Aug. 2002 (indicated at p. 2), 39 pages.

CB 130 Operating Manual Hand tool for PP/PET—strapping, Cyklop GmbH, Mar. 7, 2002 (indicated at p. 2), 22 pages.

Examination Report No. 1, from corresponding Australian Patent Application No. 2023237138, Nov. 26, 2024.

Extended European Search Report, from corresponding European Patent Application No. 21 20 5985.1, Feb. 17, 2022.

Friction Weld—Battery Powered—CB 130, Polyester / Polypropylene Friction Weld Single-Handed Operation, Cyklop International, the CB-130 tool was publicly available before the priority date of the present application, May 7, 2019.

Fromm Operation Manual / Spare Parts List, Battery—Powered Plastic Strapping Tool Model P331 M/Ha, Fromm System GmbH, Mar. 6, 2014 (indicated at p. 1), 26 pages.

Fromm Operation Manual/Spare Parts List, Battery—Powered Plastic Strapping Tool Model P328 M/HA, FROMM System GmbH, Mar. 6, 2014 (indicated at p. 1), 26 pages.

Hand Tool CB 130 Operating Instructions, Cyklop GmbH, Mar. 7, 2002 (indicated at p. 2), 26 pages.

SIAT GT One User's Manual, M. J. Maillis Group, SIAT S.p.a, May 15, 2012 (indicated at p. 99); 102 pages.

Communication pursuant to Article 94(e) EPC, cited in related European Patent Application No. 21 206 003.2, Apr. 8, 2025.

(56) References Cited

OTHER PUBLICATIONS

"Office Action and Examination Search Report", from corresponding Canadian Patent Application No. 3,137,723, Sep. 1, 2023.
First Office Action (in Japanese) from corresponding Japanese Patent Application No. 2023-218072, Feb. 18, 2025.
English Translation of Japanese First Office Action from corresponding Japanese Patent Application No. 2023-218072, Feb. 18, 2025.

* cited by examiner

STRAPPING TOOL

PRIORITY CLAIM

This continuation patent application claims priority to and the benefit of U.S. Non-Provisional patent application Ser. No. 16/852,797, which was filed on Apr. 20, 2020, which claims priority to and the benefit of U.S. Provisional Patent Application No. 62/907,248, which was filed on Sep. 27, 2019, and U.S. Provisional Patent Application No. 62/844,389, which was filed on May 7, 2019, the entire contents of each of which are incorporated herein by reference.

FIELD

The present disclosure relates to strapping tools, and more particularly to strapping tools configured to tension strap around a load and to attach overlapping portions of the strap to one another to form a tensioned strap loop around the load.

BACKGROUND

Battery-powered strapping tools are configured to tension strap around a load and to attach overlapping portions of the strap to one another to form a tensioned strap loop around the load. To use one of these strapping tools to form a tensioned strap loop around a load, an operator pulls strap leading-end first from a strap supply, wraps the strap around the load, and positions the leading end of the strap below another portion of the strap. The operator then introduces one or more (depending on the type of strapping tool) of these overlapped strap portions into the strapping tool and actuates one or more buttons to initiate: (1) a tensioning cycle during which a tensioning assembly tensions the strap around the load; and (2) after completion of the tensioning cycle, a sealing cycle during which a sealing assembly attaches the overlapped strap portions to one another (thereby forming a tensioned strap loop around the load) and during which a cutting assembly cuts the strap from the strap supply.

How the strapping tool attaches overlapping portions of the strap to one another during the sealing cycle depends on the type of strapping tool and the type of strap. Certain strapping tools configured for plastic strap (such as polypropylene strap or polyester strap) include friction welders, heated blades, or ultrasonic welders configured to attach the overlapping portions of the strap to one another. Some strapping tools configured for plastic strap or metal strap (such as steel strap) include jaws that mechanically deform (referred to as "crimping" in the strapping industry) or cut notches into (referred to as "notching" in the strapping industry) a seal element positioned around the overlapping portions of the strap to attach them to one another. Other strapping tools configured for metal strap include punches and dies configured to form a set of mechanically interlocking cuts in the overlapping portions of the strap to attach them to one another (referred to in the strapping industry as a "sealless" attachment).

SUMMARY

Various embodiments of the present disclosure provide a strapping tool configured to tension metal strap around a load and, after tensioning, attach overlapping portions of the strap to one another by cutting notches into a seal element positioned around the overlapping portions of the strap and into the overlapping portions of the strap themselves.

DETAILED DESCRIPTION

Figure 1A:
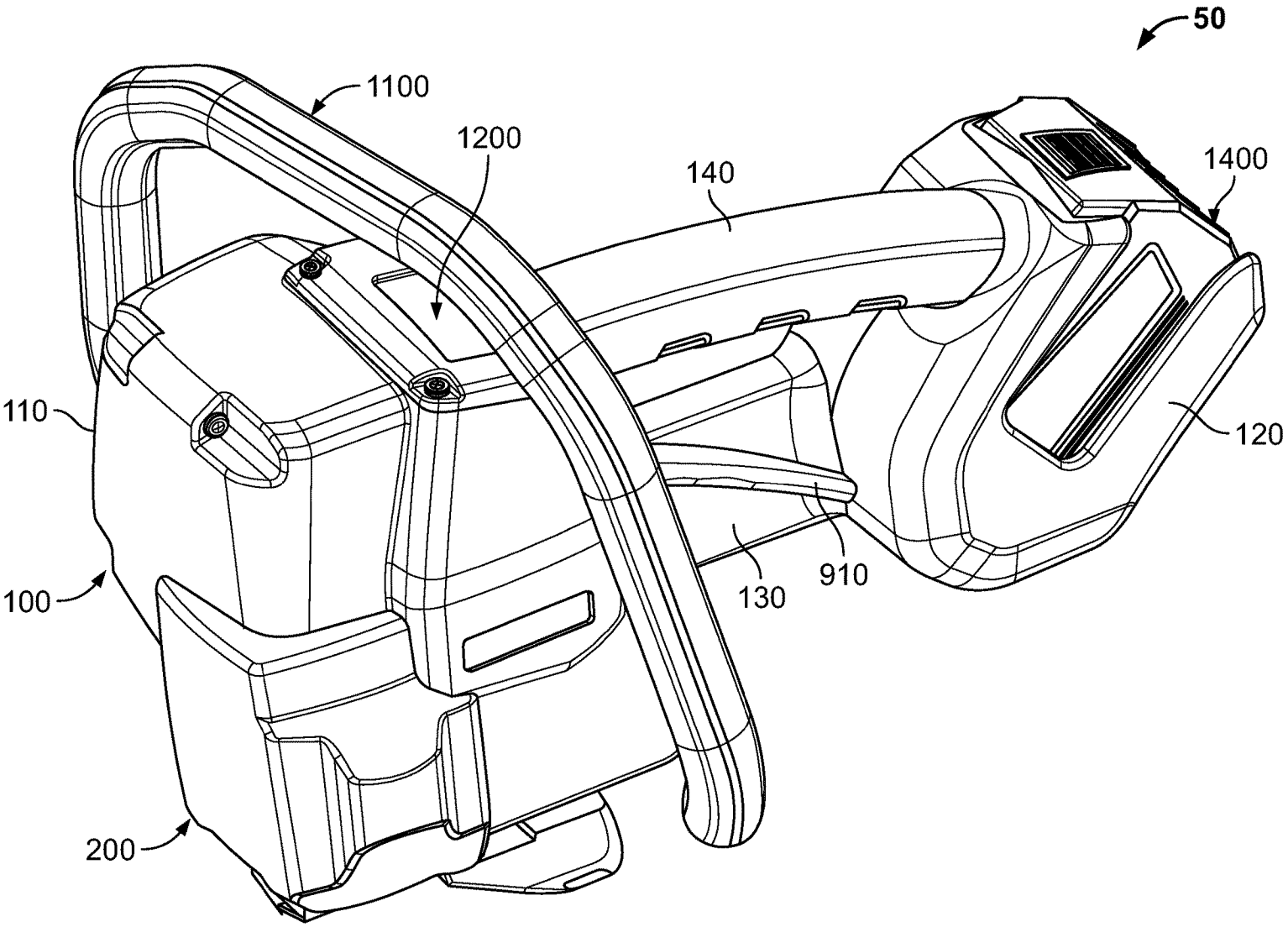
FIGS. 1A and 1B are perspective views of one example embodiment of a strapping tool of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 1B:
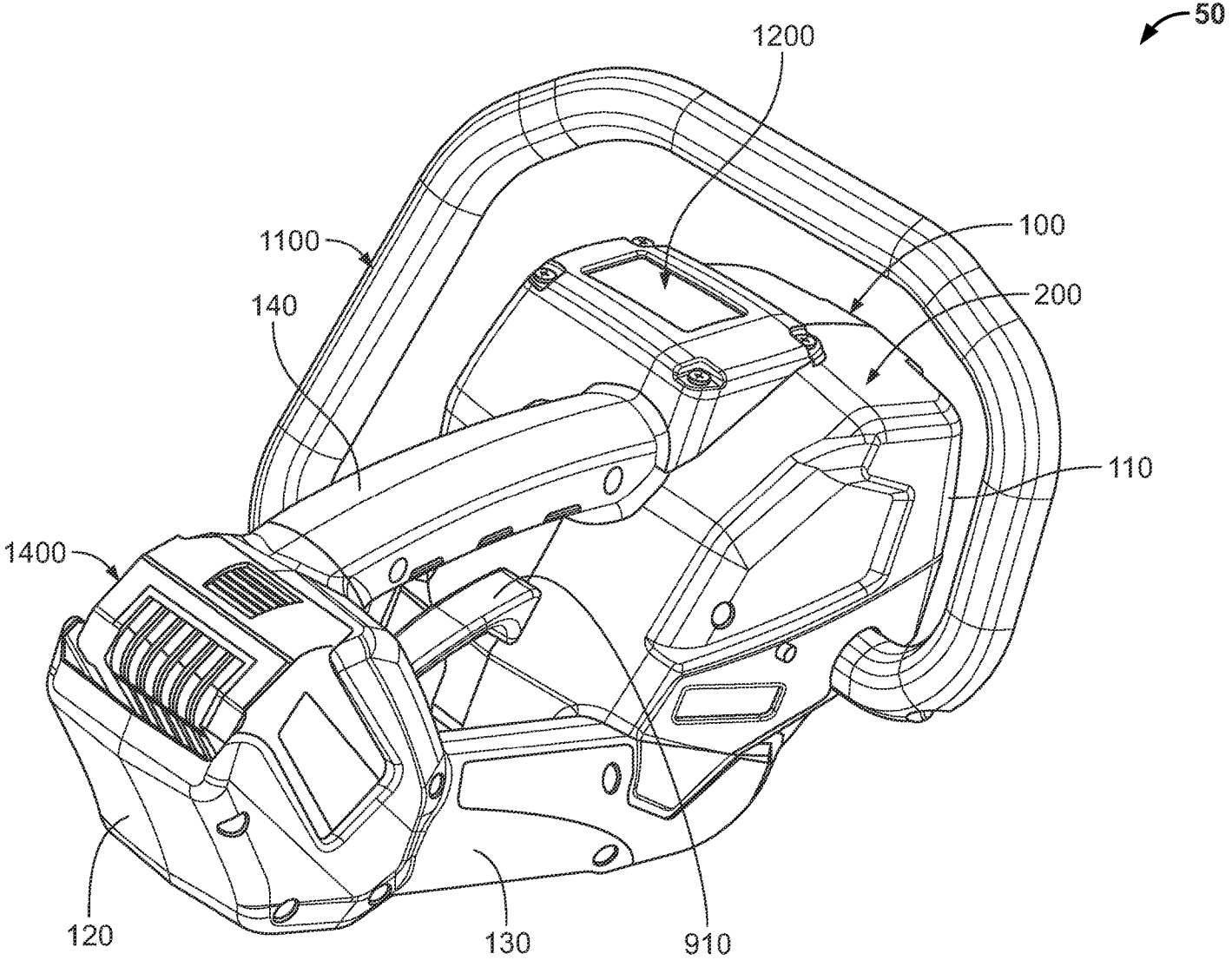
Figure 2:
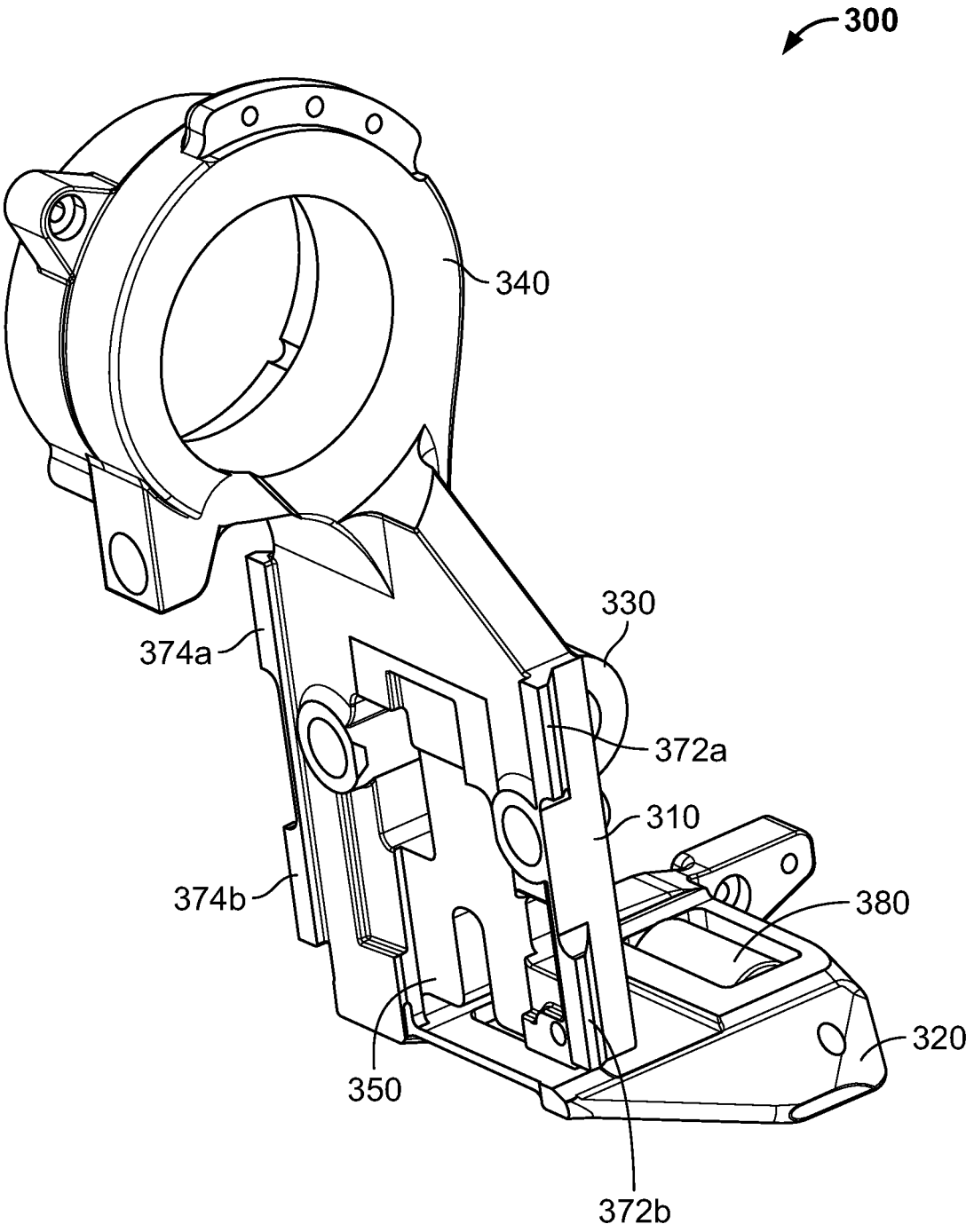
FIG. 2 is a front perspective view of the support of the working assembly of the strapping tool of FIG. 1A.

FIGS. 1A and 1B show one example embodiment of the strapping tool 50 of the present disclosure (sometimes referred to as the "tool" in the Detailed Description for brevity) and certain assemblies and components thereof. The strapping tool 50 is configured to tension strap (metal strap in this example embodiment) around a load and, after tensioning, attach overlapping portions of the strap to one another by cutting notches into a seal element positioned around the overlapping portions of the strap and into the overlapping portions of the strap themselves (referred to as "notching" in the strapping industry and in this Detailed Description) and cut the strap from the strap supply.

The strapping tool 50 includes a housing 100, a working assembly 200, a movable handle assembly 1100, a display assembly 1200, a controller 1300 (not shown in the drawings but numbered for clarity), and a power supply 1400.

The housing 100, which is best shown in FIGS. 1A and 1B, at least partially encloses and/or supports some (or all) of the other assemblies and components of the strapping tool 50. In this example embodiment, the housing 100 includes a front housing section 110 that at least partially encloses and/or supports at least some of the components of the working assembly 200 and the movable handle assembly 1100, a rear housing section 120 that at least partially encloses and/or supports the controller 1300 and the power supply 1400, a connector housing section 130 that extends between and connects the bottoms of the front and rear housing sections 110 and 120, and a stationary handle 140 that extends between and connects the tops of the front and rear housing sections 110 and 120. The housing 100 may be formed from any suitable quantity of components joined together in any suitable manner. In this example embodiment, the housing 100 is formed from plastic, though it may be made from any other suitable material in other embodiments.

The working assembly 200, the subassemblies and components of which are best shown in FIGS. 2-14H and 16A-16C, includes the majority of the components of the strapping tool 50 that are configured to tension the strap around the load, attach the overlapping portions of the strap to one another, and cut the strap from the strap supply. The working assembly 200 includes a support 300, a tensioning assembly 400, a sealing assembly 500, a drive assembly 700, a rocker-lever assembly 900, and a gate assembly 1000.

The support 300, which is best shown in FIGS. 2-4 and 10A-11B, serves as a direct or indirect common mount for the tensioning assembly 400, the sealing assembly 500, the drive assembly 700, the rocker-lever assembly 900, and the gate assembly 1000. The support 300 includes a body 310, a foot 320 extending transversely from a bottom of the body 310, a tensioning-assembly-mounting element 330 extending rearward from the body 310, and a drive-and-conversion-assembly-mounting element 340 extending upwardly from the body 310. A front side of the body 310 defines a gate-receiving recess 350 sized, shaped, oriented, and otherwise configured to receive a gate 1010 of the gate assembly 1000 and to enable the gate 1010 to move between a lower home position and an upper strap-insertion position (described below). The body 310 includes aligned first and second sealing-assembly-mounting tongues 372*a* and 372*b* on one side of the gate-receiving recess 350 and aligned third and fourth sealing-assembly-mounting tongues 374*a* and 374*b* on the other side of the gate-receiving recess 350. A roller 380 is coupled to and freely rotatable relative to the foot 320.

Figure 3A:
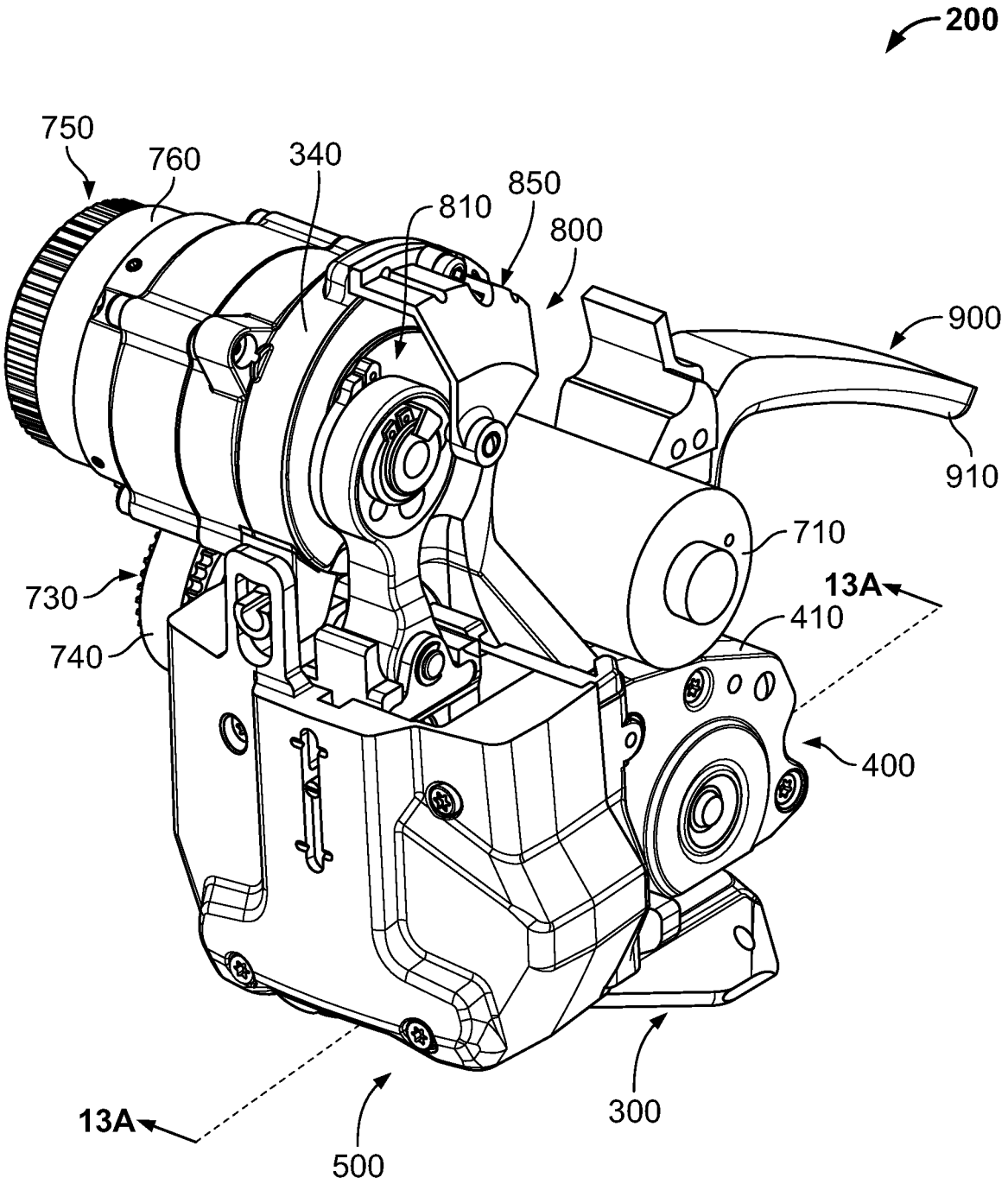
FIGS. 3A-3D are perspective views of the working assembly of the strapping tool of FIG. 1A.
Figure 3B:
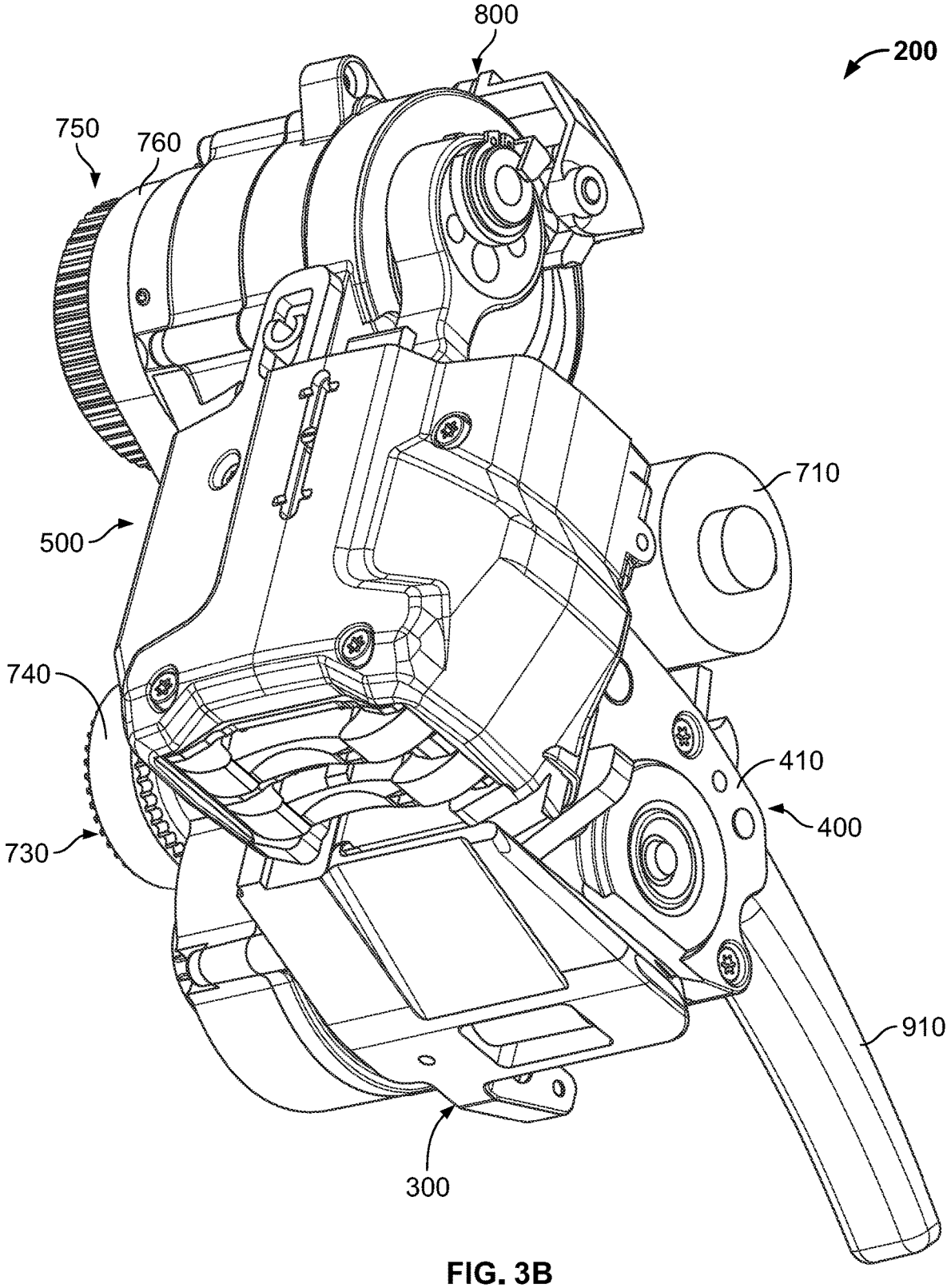
Figure 3C:
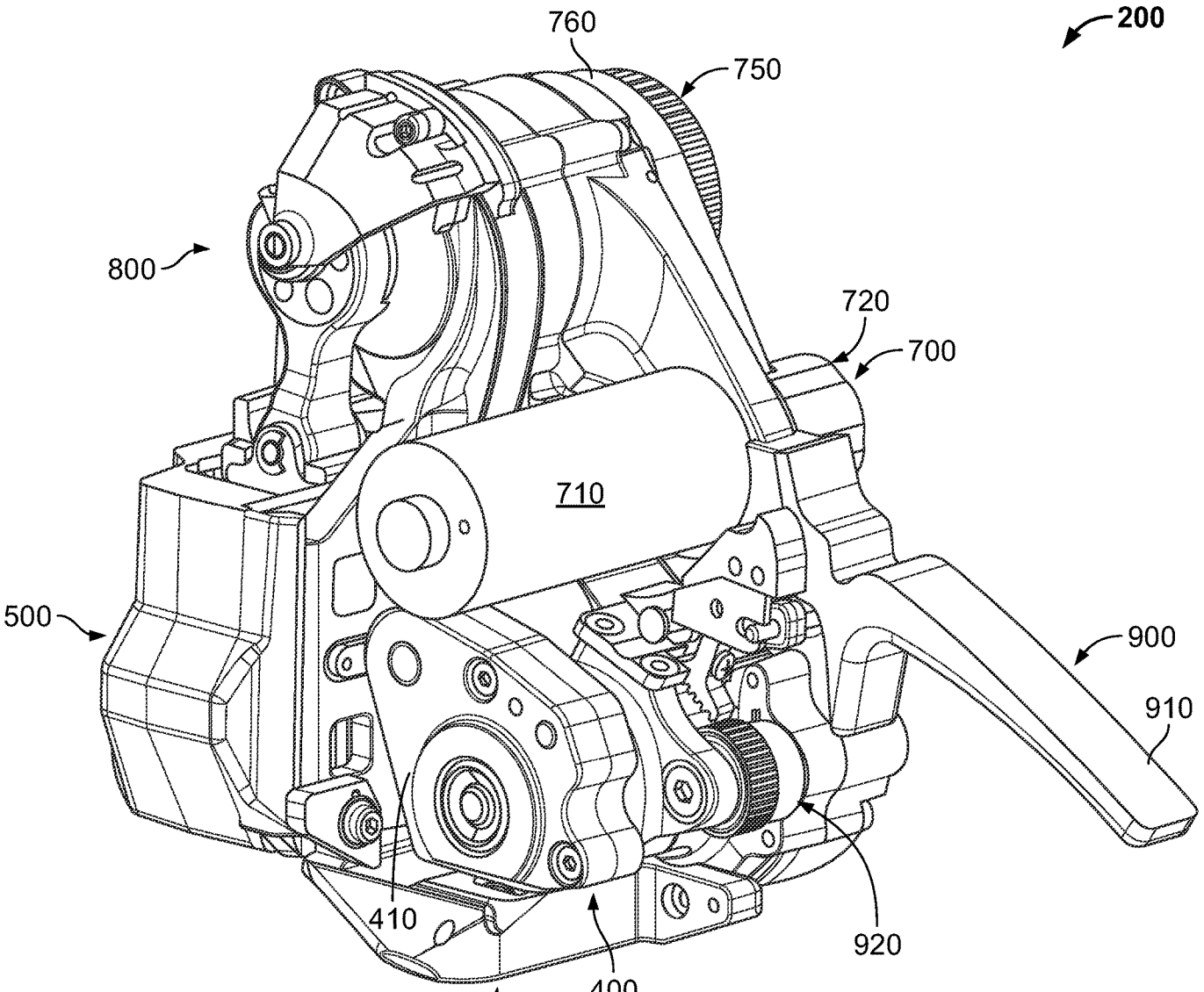
Figure 3D:
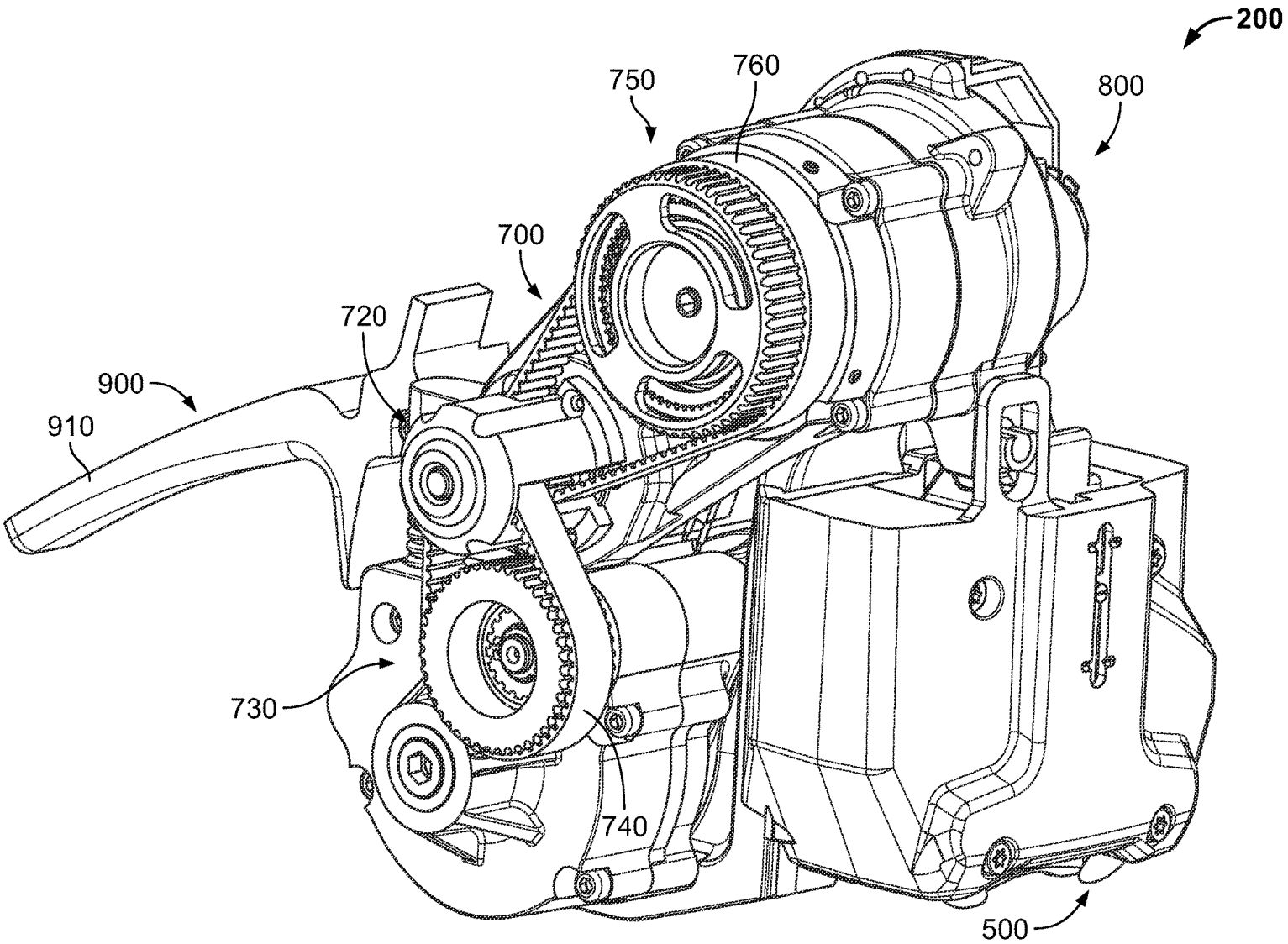
Figure 4:
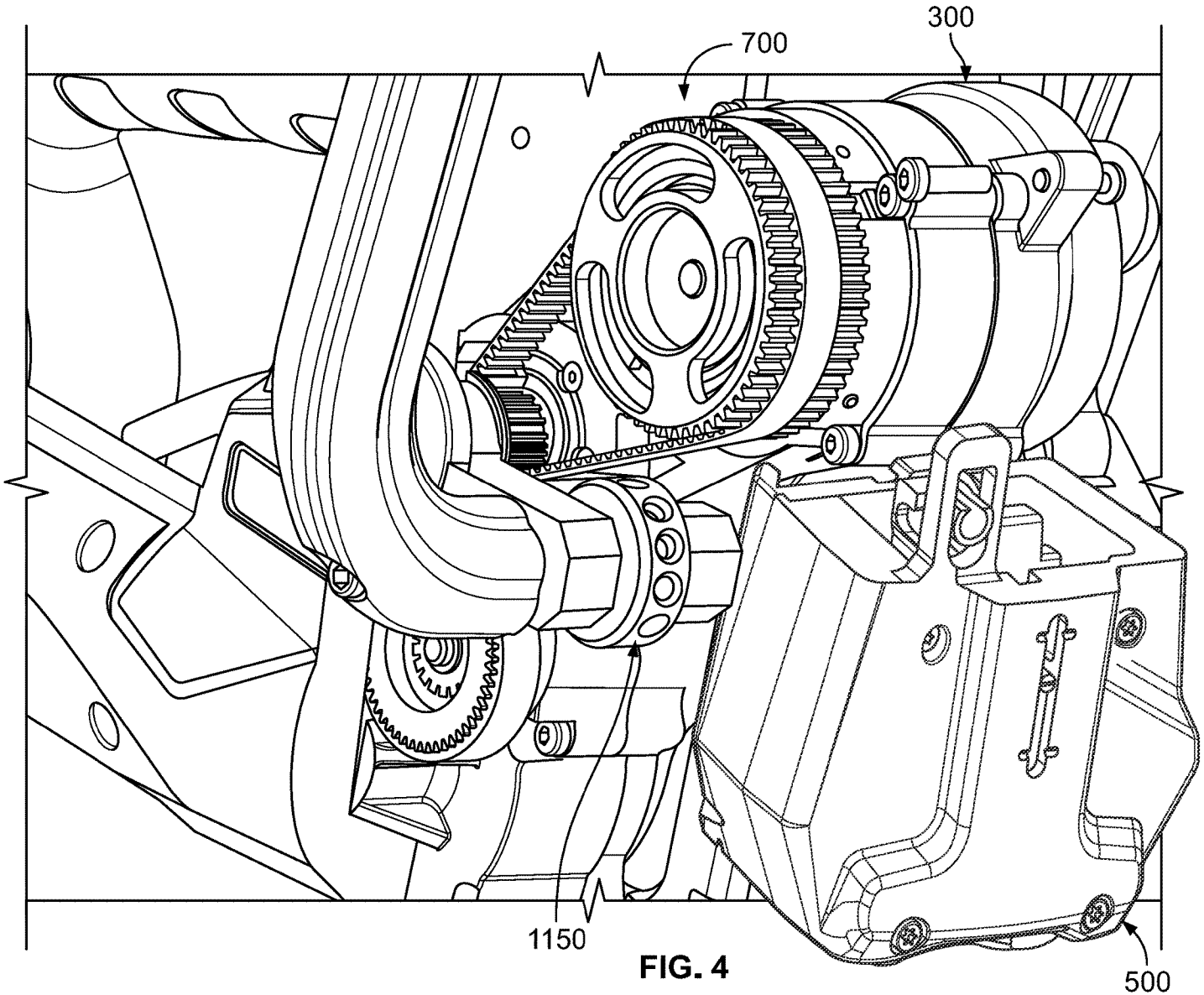
FIG. 4 is an enlarged fragmentary perspective view of the working assembly of FIG. 3A and the movable handle assembly of the strapping tool of FIG. 1A.
Figure 10A:
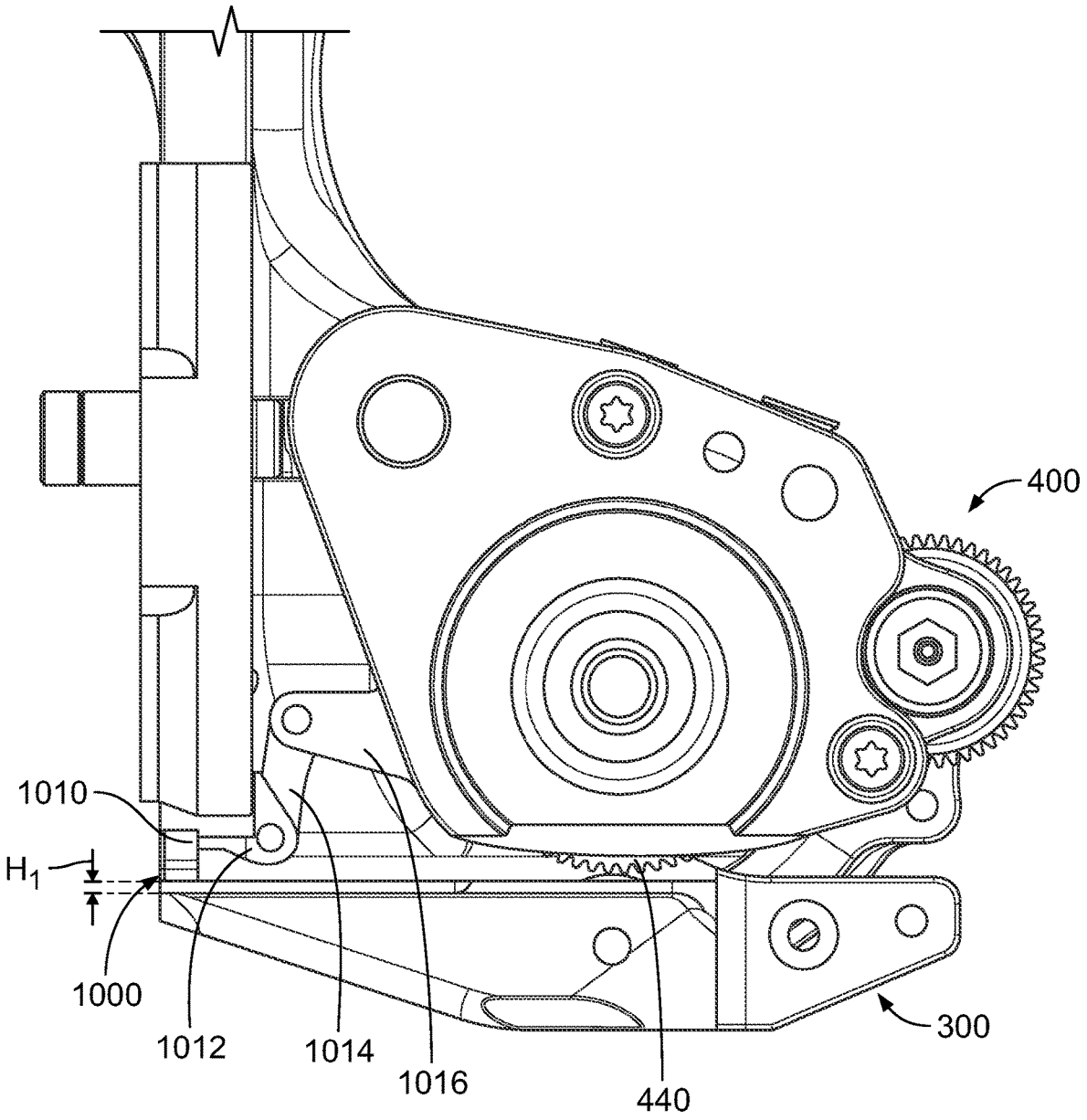
FIGS. 10A and 10B are side-elevational and perspective views, respectively, of part of the tensioning assembly and the gate assembly of the working assembly of FIG. 3A. The tensioning assembly and the gate of the gate assembly are in their respective strap-tensioning and home positions.
Figure 10B:
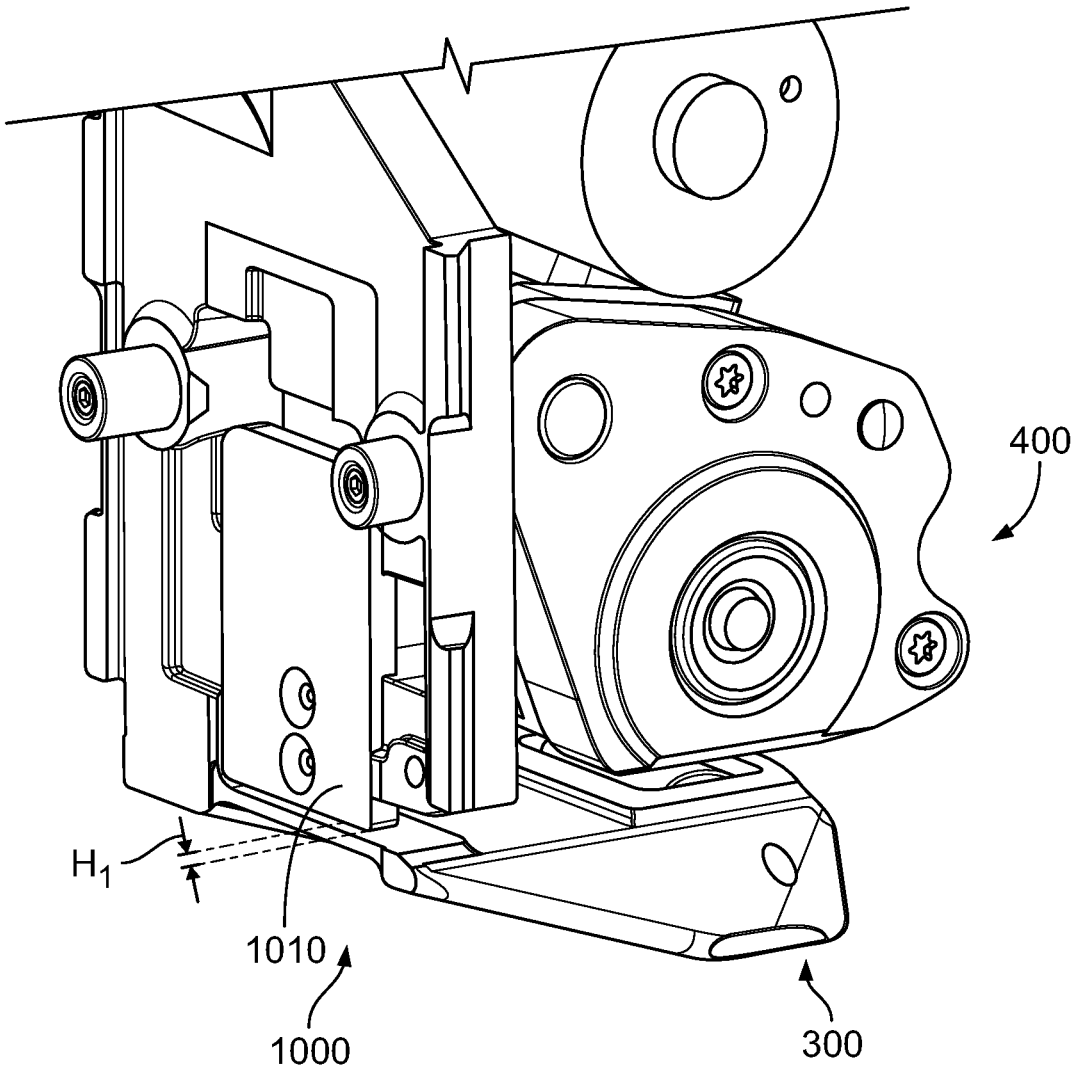
Figure 11A:
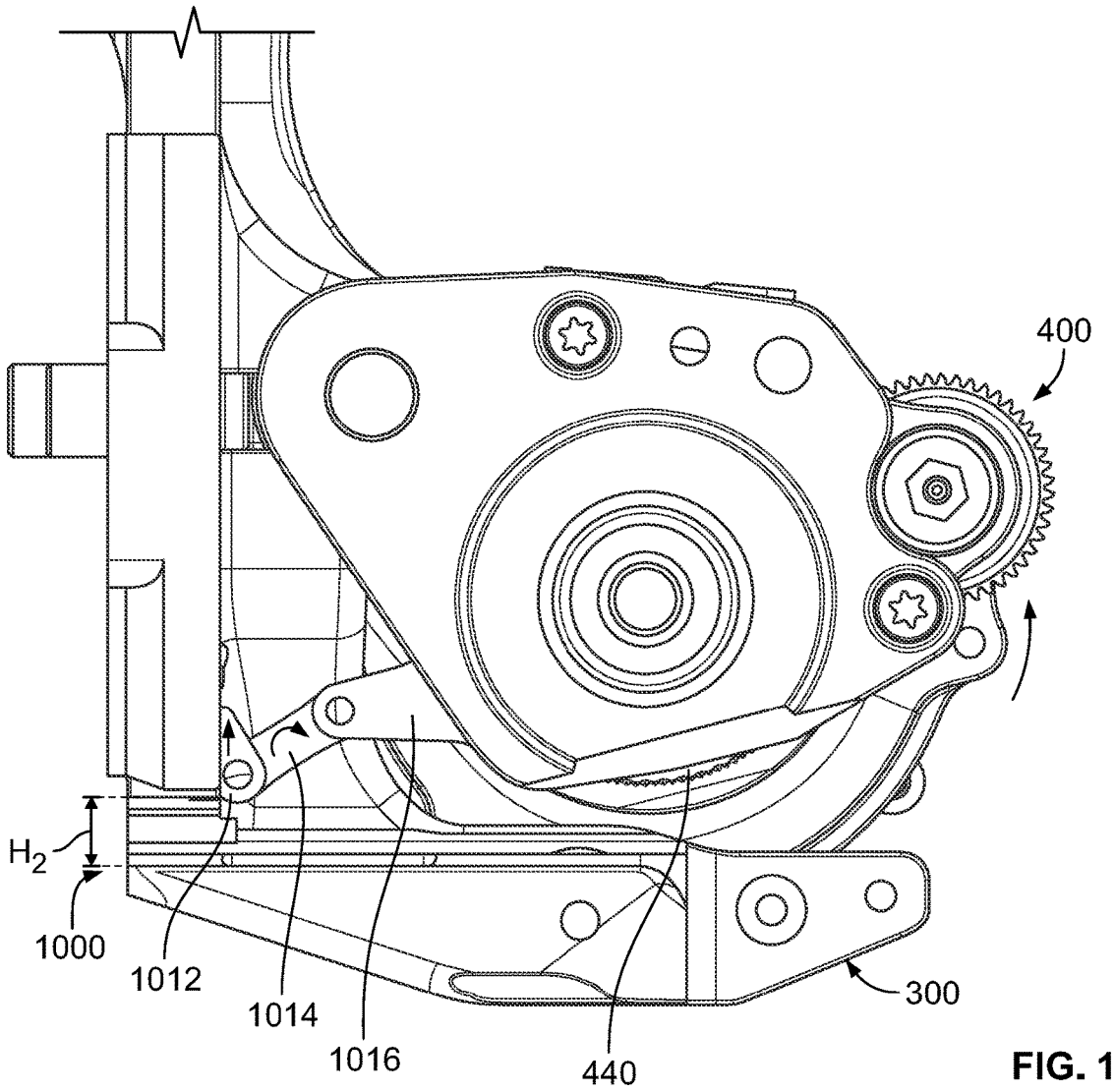
FIGS. 11A and 11B are side-elevational and perspective views, respectively, of the part of the tensioning assembly and the gate assembly shown in FIGS. 10A and 10B. The tensioning assembly and the gate of the gate assembly are in their respective strap-insertion positions.

The tensioning assembly 400, which is best shown in FIGS. 3C, 10A, and 11A, is configured to tension the strap around the load. The tensioning assembly 400 includes a tension shaft (not shown), a tension wheel 440 (FIGS. 10A and 11A) fixedly attached to the tension shaft to rotate therewith, tensioning-assembly gearing (not shown) operably connected to the tension shaft and configured to rotate the tension shaft (and the tension wheel 440 attached thereto), and a tensioning assembly housing 410 at least partially enclosing these components.

Figure 11B:
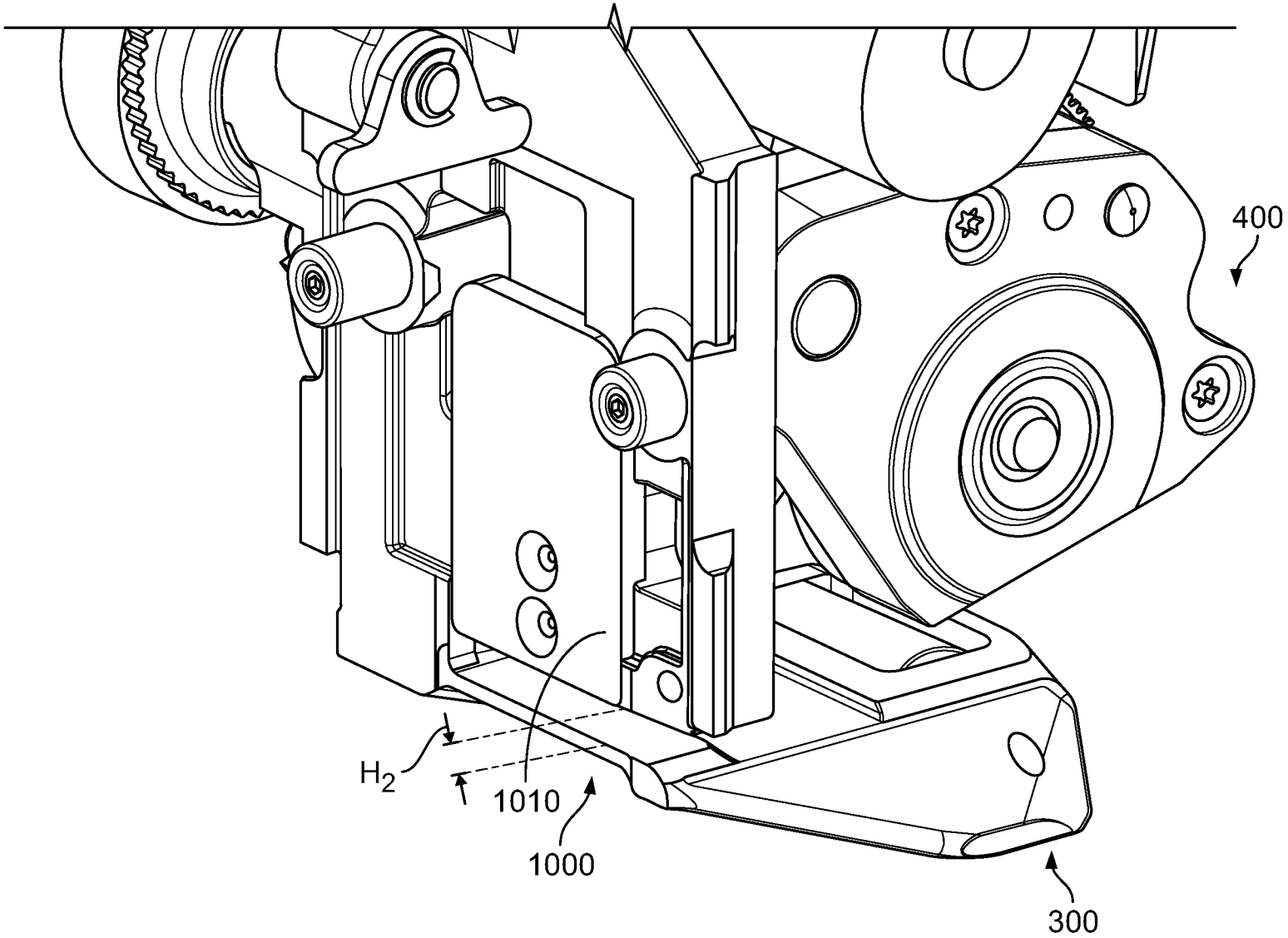

The tensioning assembly 400 is movably mounted to the tensioning-assembly-mounting element 320 of the support 300 and configured to pivot relative to the support 300—and particularly relative to the foot 320 of the support 300—under control of the rocker-lever assembly 900 (as described below) between a strap-tensioning position (FIGS. 10A and 10B) and a strap-insertion position (FIGS. 11A and 11B). When the tensioning assembly 400 is in the strap-tensioning position, the tension wheel 440 is adjacent to (and in this embodiment contacts) the roller 380 of the support 300 (or the upper surface of the strap if the strap has been inserted into the strapping tool 50). When the tensioning assembly 400 is in the strap-insertion position, the tension wheel 440 is spaced-apart from the roller 380 to enable the top portion of the strap (described below) to be inserted between the tension wheel 440 and the roller 280. A tensioning-assembly-biasing element (not shown) such as a torsion spring, a compression spring, or any other suitable type of spring biases the tensioning assembly 400 to the strap-tensioning position.

The rocker-lever assembly 900, which is best shown in FIG. 3C, is operably connected to the tensioning assembly 400 and configured to move the tensioning assembly 400 relative to the support 300 from the strap-tensioning position to the strap-insertion position. The rocker-lever assembly 900 includes a rocker lever 910, rocker-lever gearing (not labeled), and a spring-clutch assembly 920. The rocker-lever gearing operably connects the rocker lever 910 to the tensioning assembly 400 such that movement (here, pivoting) of the rocker lever 910 relative to the support 300 and the housing 100 from a home position (best shown in FIG. 3C) to an actuated position (not shown) causes the rocker-lever gearing to cause the tensioning assembly 400 to move from the strap-tensioning position to the strap-insertion position. Movement of the rocker lever 910 from the actuated position back to the home position (such as under control of the tensioning-assembly biasing element) causes the rocker-lever gearing to cause the tensioning assembly 400 to return to the strap-tensioning position. Put differently, the rocker lever 910 is movable between the home position and the actuated position to (via the rocker-lever gearing) cause the tensioning assembly 400 to move between the strap-tensioning position and the strap-insertion position, respectively. The spring-clutch assembly 920 is configured to act on a gear component of the tensioning-assembly gearing to facilitate a soft release of the strap after tensioning and sealing. Specifically, as the rocker lever 910 moves from its home position to its actuated position, the spring-clutch assembly 920 decouples the tensioning-assembly gearing from the tension wheel 440. This enables the tensioning wheel 440 to, while decoupled from the tensioning-assembly gearing (and therefore the motor 710), rotate in a direction opposite the tensioning direction. This facilitates removal of the tool 50 from the strap after the tensioning and sealing processes are complete.

The sealing assembly 500, which is best shown in FIGS. 5A-9B, is configured to attach overlapping portions of the strap to one another to form a tensioned strap loop around the load by notching both a seal element positioned around the overlapping portions of the strap and the overlapping portions of the strap themselves. The sealing assembly 500 includes a front cover 502; a back cover 506; connectors 512, 514, 516, and 518; a jaw assembly 520; and an object-blocking assembly 600.

Figure 5A:
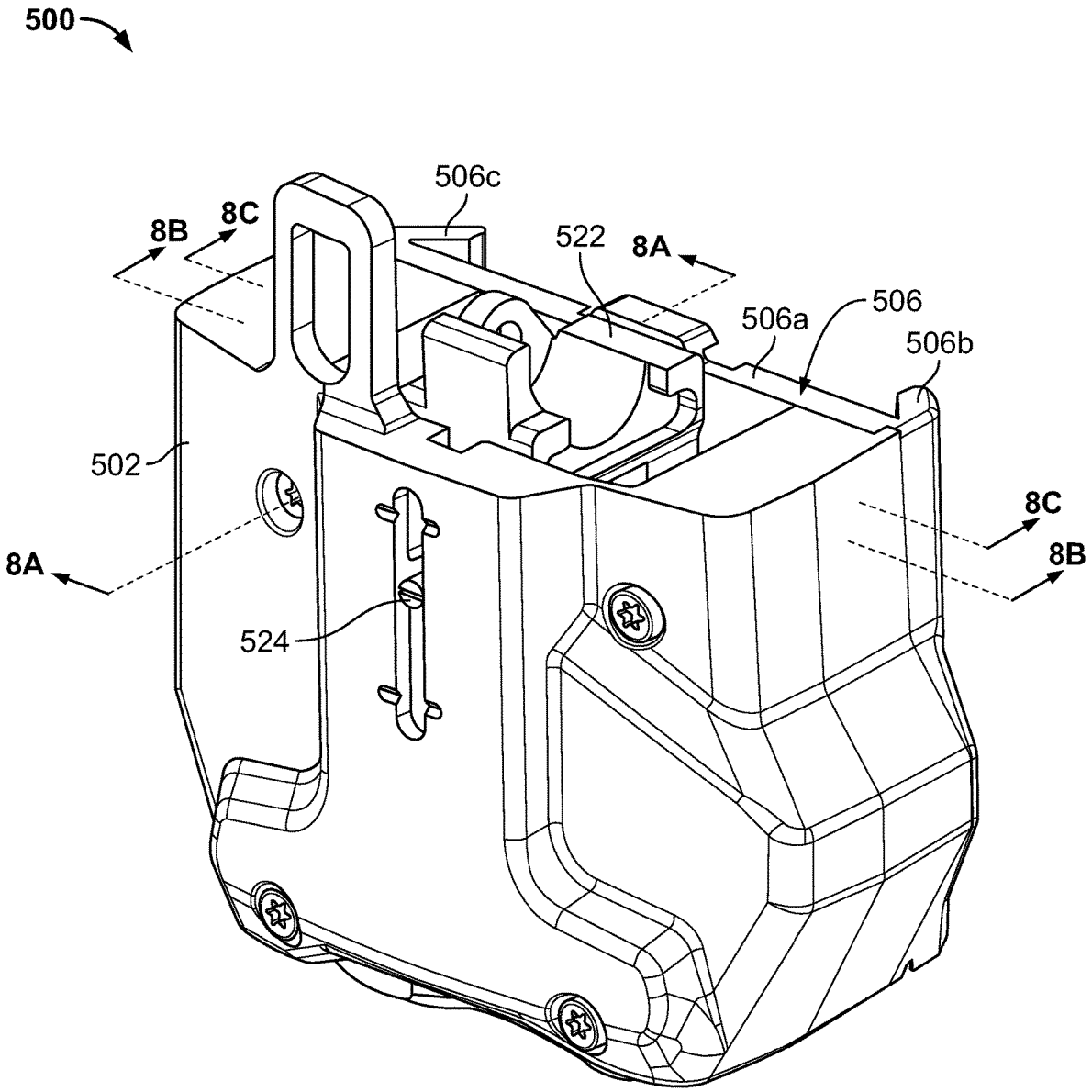
FIGS. 5A and 5B are perspective views of the sealing assembly of the working assembly of FIG. 3A.
Figure 5B:
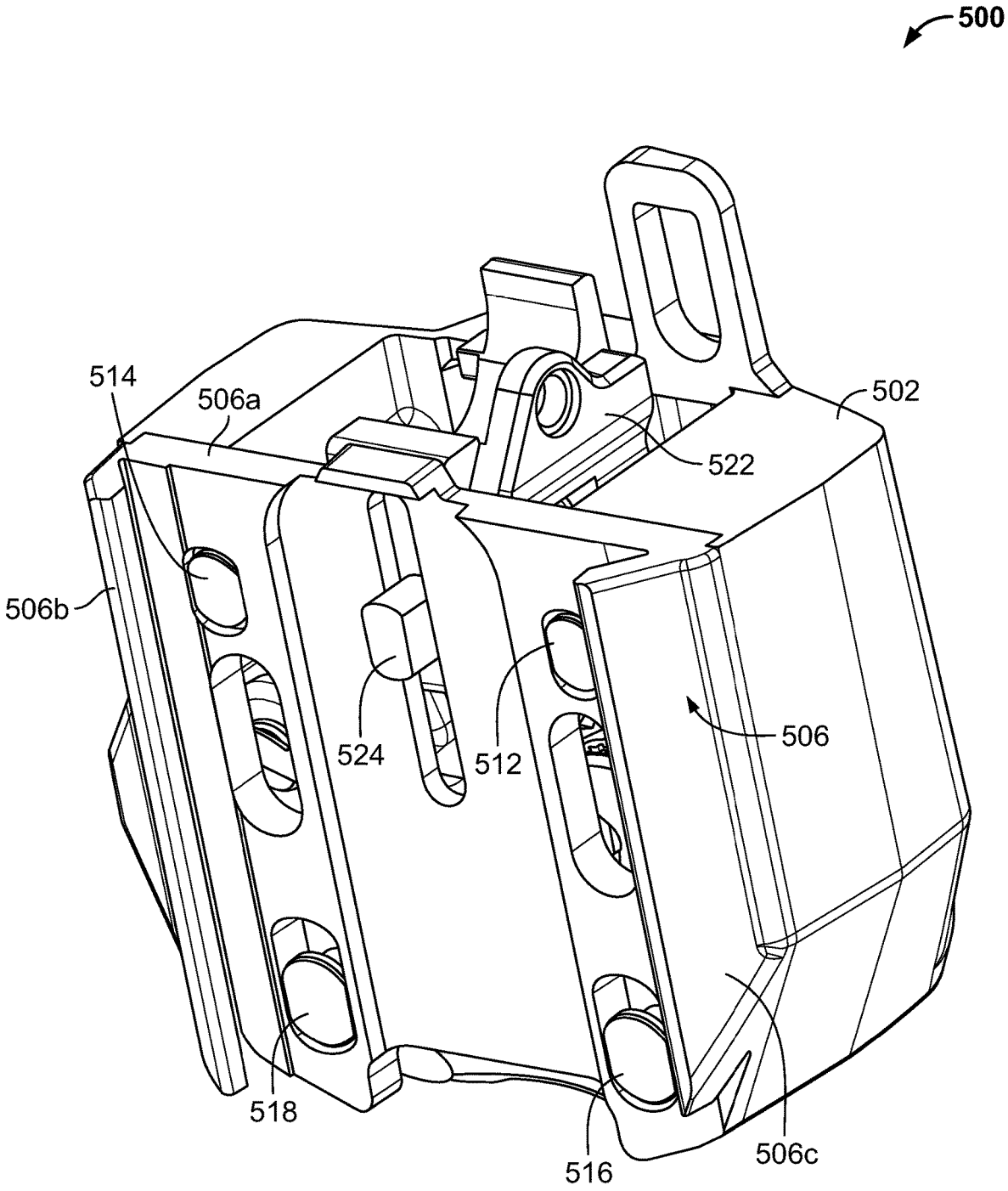
Figure 5C:
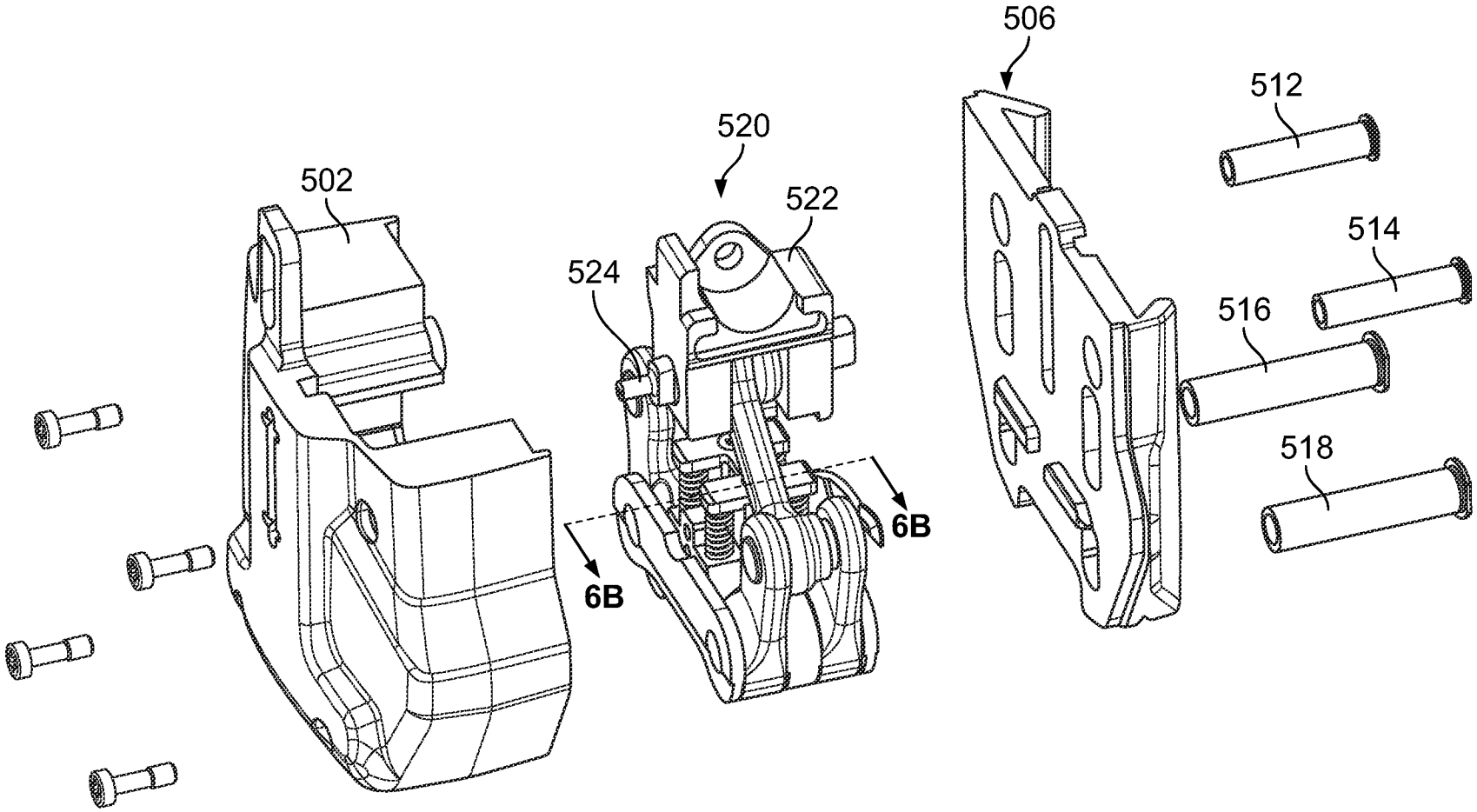
FIGS. 5C and 5D are a partially exploded perspective views of the sealing assembly of FIG. 5A.

The front cover 502 is generally U-shaped. The back cover 506 includes a generally planar base 506*a*, two mounting wings 506*b* and 506*c* extending rearward and inward from opposing lateral ends of the base 506*a*, and lips 506*d* extending forward from the base 506*a* (toward the jaw assembly 520). As best shown in FIG. 5C, the front cover 502 and the back cover 506 are connected to one another via the connectors 512, 514, 516, and 518 and suitable fasteners (not labeled) and cooperate to partially enclose the jaw assembly 520 and the object-blocking assembly 600.

Figure 9A:
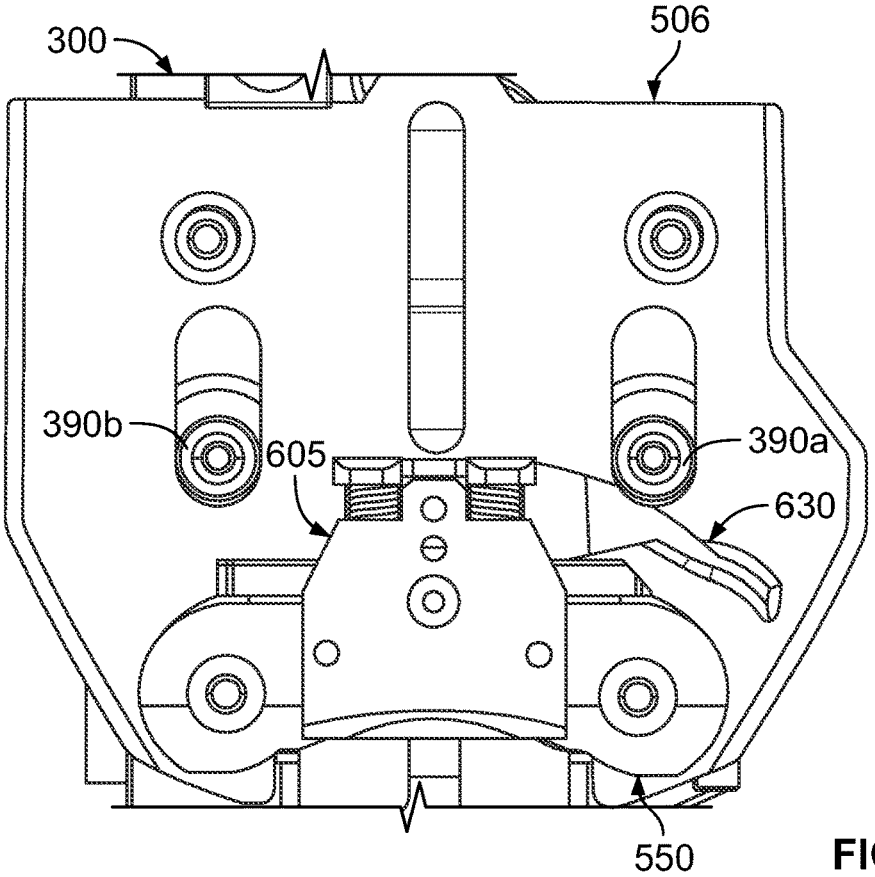
FIG. 9A is a front elevational view of part of the sealing assembly of FIG. 5A showing the sealing assembly in its home position and the object blocker of the object-blocking assembly of FIG. 6A in its retracted position.
Figure 9B:
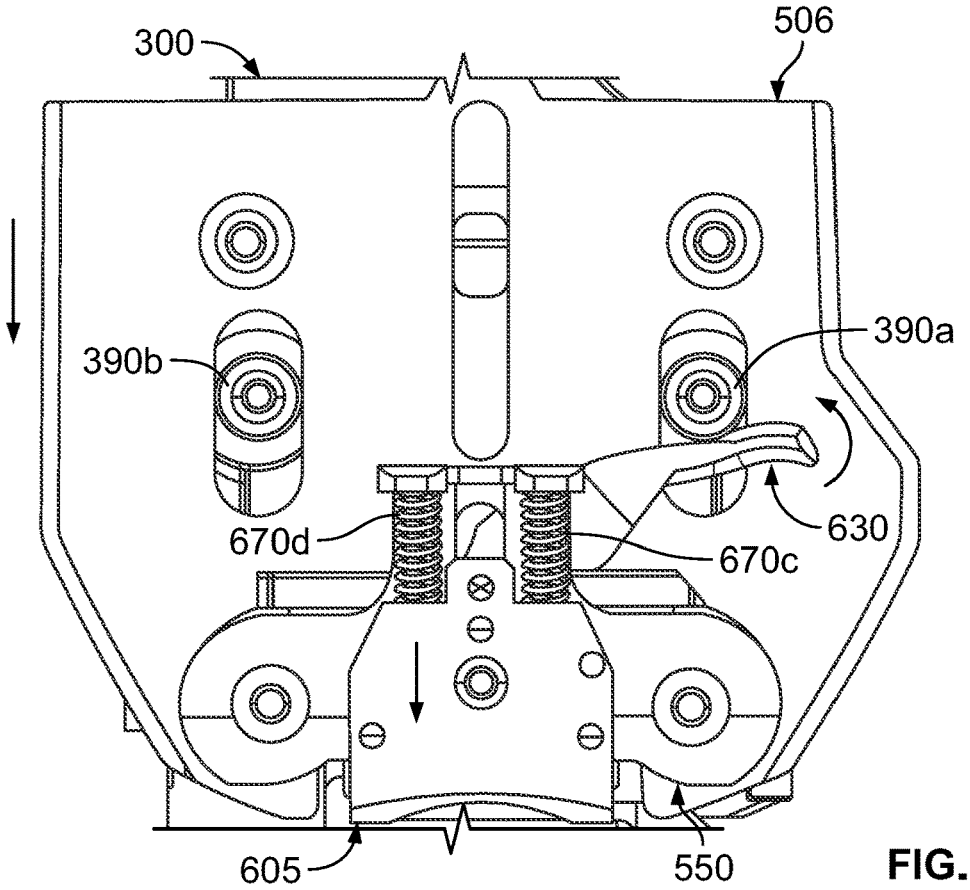
FIG. 9B is a front elevational view of part of the sealing assembly of FIG. 5A showing the sealing assembly moved about halfway from its home position to its sealing position and the object blocker of the object-blocking assembly of FIG. 6A in its blocking position.

The sealing assembly 500 is movably (and more particularly, slidably) mounted to the support 300 via the back cover 506. Specifically, the back cover 506 is positioned so the first and second sealing-assembly-mounting tongues 372*a* and 372*b* of the support 300 are received in a groove defined between the base 506*a* and the first mounting wing 506*b* and so the third and fourth sealing-assembly-mounting tongues 374*a* and 374*b* of the support 300 are received in a groove defined between the base 506*a* and the second mounting wing 506*c*. This mounting configuration enables the sealing assembly 500 to move vertically relative to the support 300 and prevents the sealing assembly 500 from moving side-to-side or forward and rearward relative to the support 300. As best shown in FIGS. 9A and 9B, laterally-spaced-apart first and second sealing-assembly-mounting elements 390*a* and 390*b* are fixedly attached to the body 310 of the support 300 and extend through respective vertically-extending slots (not labeled) defined through the base 506*a* of the back cover 506. These slots and sealing-assembly-mounting elements 390*a* and 390*b* co-act to constrain the vertical movement of the sealing assembly 500 relative to the support 300 between an (upper) home position (FIGS. 9A and 16A) at which the sealing-assembly-mounting elements 390*a* and 390*b* are at the lower ends of the slots and a (lower) sealing position (FIGS. 9B, 16B, and 16C) at which the sealing-assembly-mounting elements 390*a* and 390*b* are at the upper ends of the slots. As explained below, the drive assembly 700 controls movement of the sealing assembly 500 between its home and sealing positions.

Figure 5D:
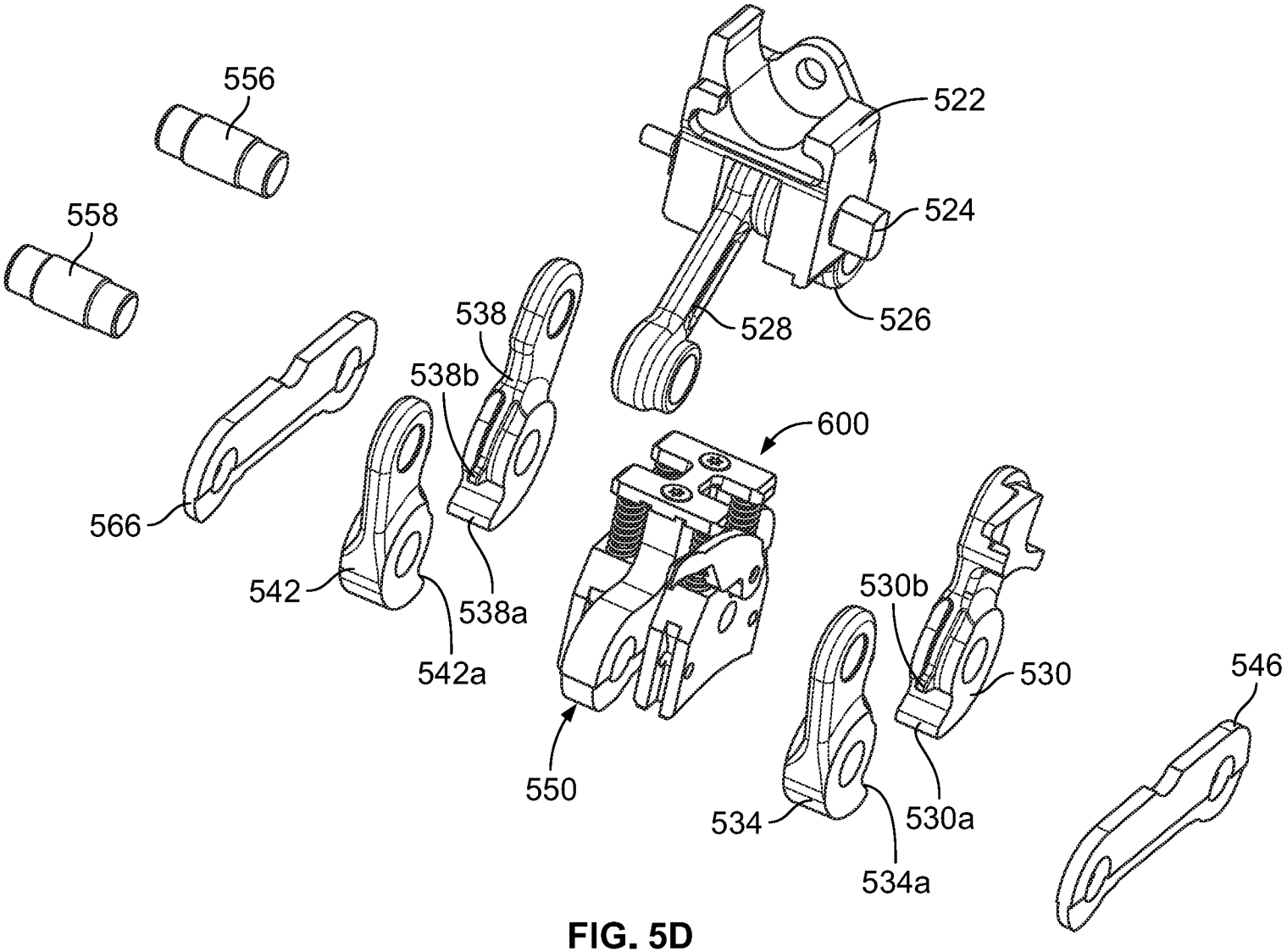

As best shown in FIGS. 5C and 5D, the jaw assembly 520 includes a coupler 522, a pivot pin 524, first and second upper linkages 526 and 528, first and second inner jaws 530 and 534, first and second outer jaws 538 and 542, an inner jaw connector 546, a central jaw connector 550, and an outer jaw connector 566.

The pivot pin 524 is connected to the coupler 522 so the pivot pin 524 is rotatable relative to the coupler 522. As best shown in FIGS. 5A and 5B, the opposing ends of the pivot pin 524 are positioned in slots (not labeled) defined in the front and back covers 502 and 506 so the slots limit the pivot pin 524 to moving vertically between an upper and a lower position. The first and second upper linkages 526 and 528 are each pivotably connected to the pivot pin 524 near their respective upper ends. This pivotable connection enables the first and second upper linkages 526 and 528 to pivot relative to the coupler 522 and the pivot pin 524 about a longitudinal axis of the pivot pin 524 (not shown). The respective upper portions of each of the first and second inner jaws 530 and 534 are pivotably connected to the respective lower ends of the upper linkages 526 and 528 via pivot pins 556 and 558, respectively. The respective upper portions of each of the first and second outer jaws 538 and 542 are pivotably connected to the respective lower ends of the upper linkages 526 and 528 via the pivot pins 556 and 558. These pivotable connections enable the first inner and outer jaws 530 and 538 to pivot relative to the upper linkage 526 about a longitudinal axis of the pivot pin 556 (not shown) and the second inner and outer jaws 534 and 542 to pivot relative to the upper linkage 528 about a longitudinal axis (not shown) of the pivot pin 558.

Figure 16A:
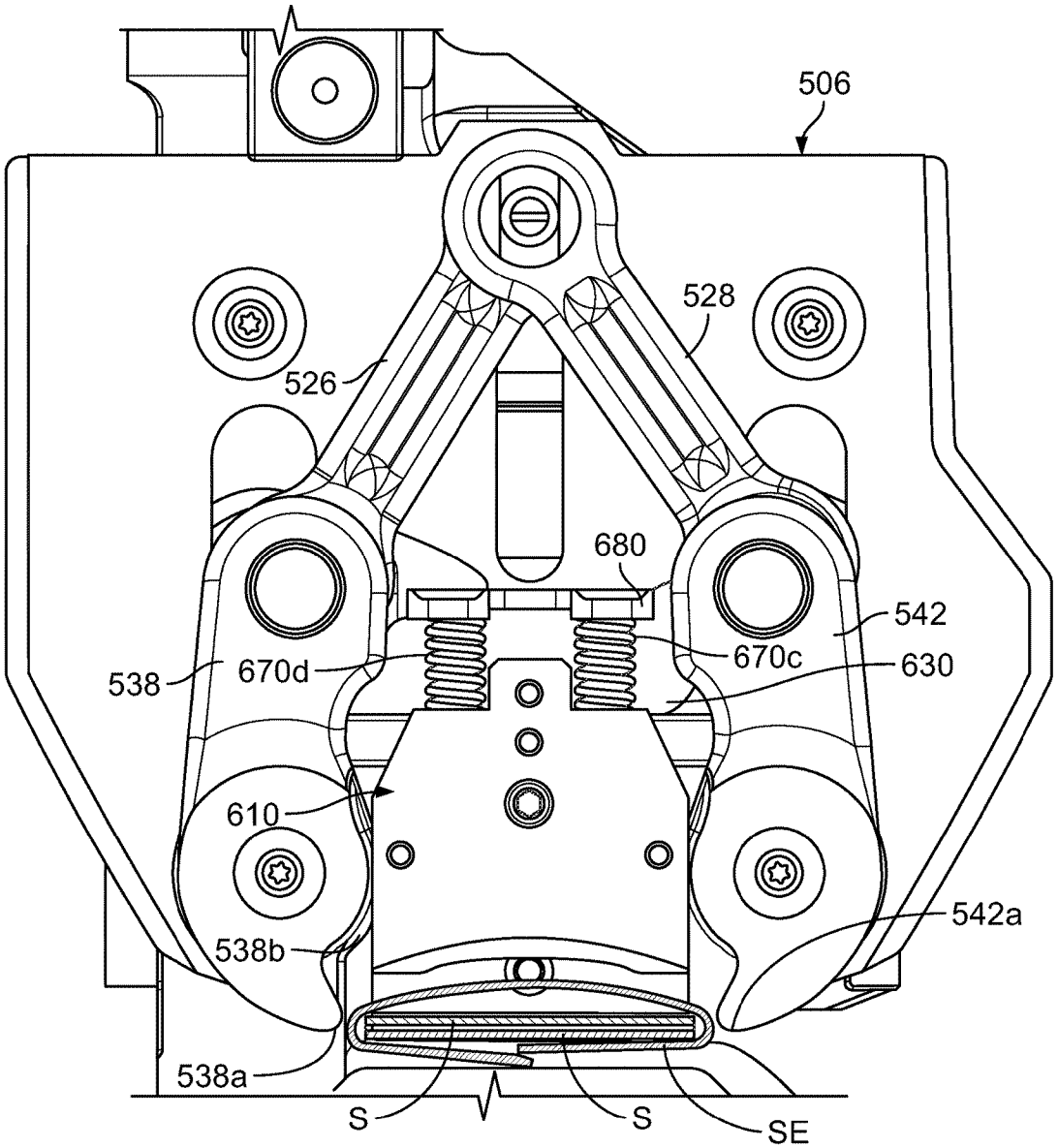
FIG. 16A is a front elevational view of part of the support of FIG. 2 and part of the sealing assembly of FIG. 5A with the sealing assembly and the jaws in their home positions.
Figure 16B:
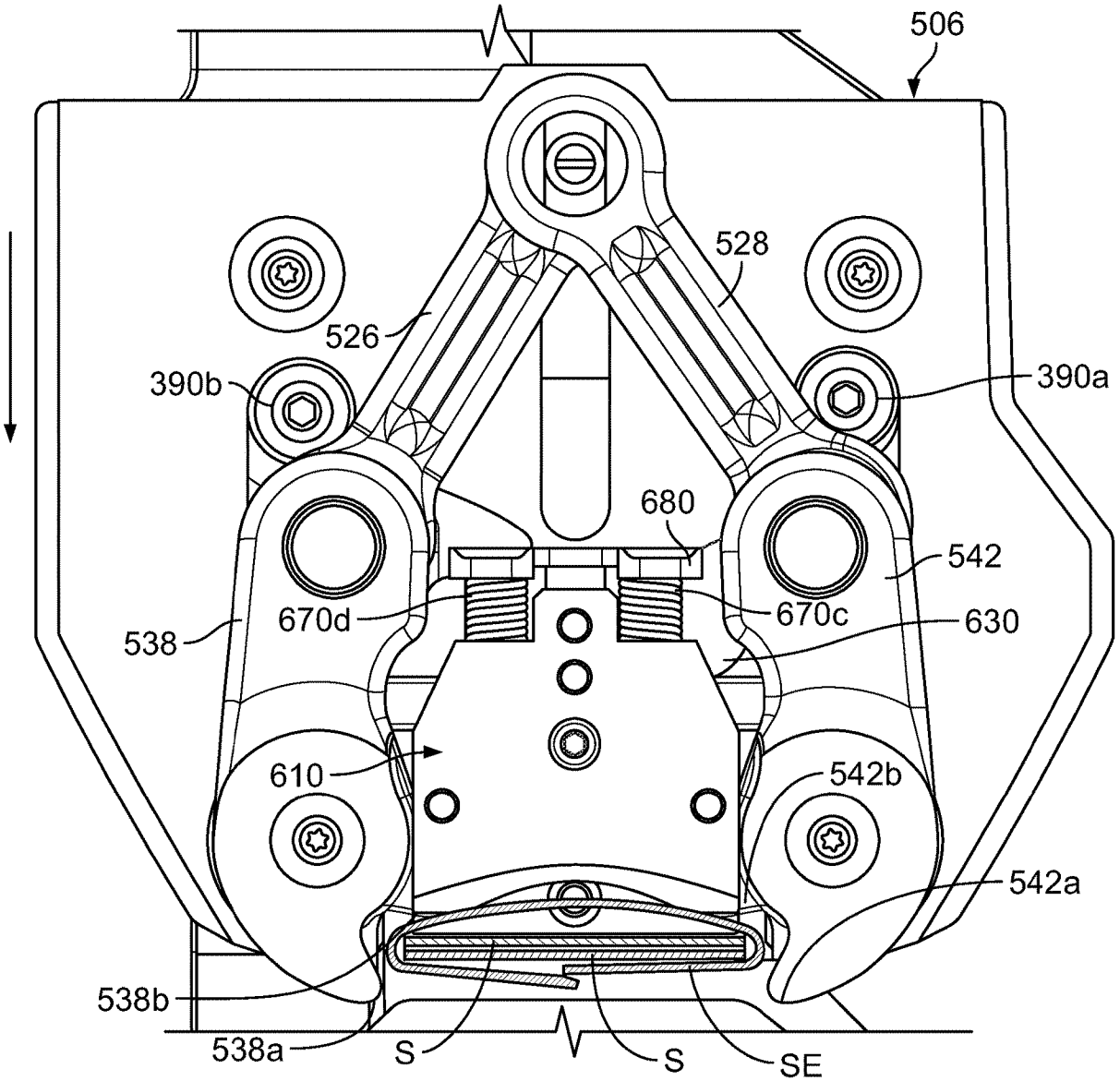
FIG. 16B is a front elevational view of part of the support of FIG. 2 and part of the sealing assembly of FIG. 5A with the sealing assembly in its sealing position and the jaws in their home positions.
Figure 16C:
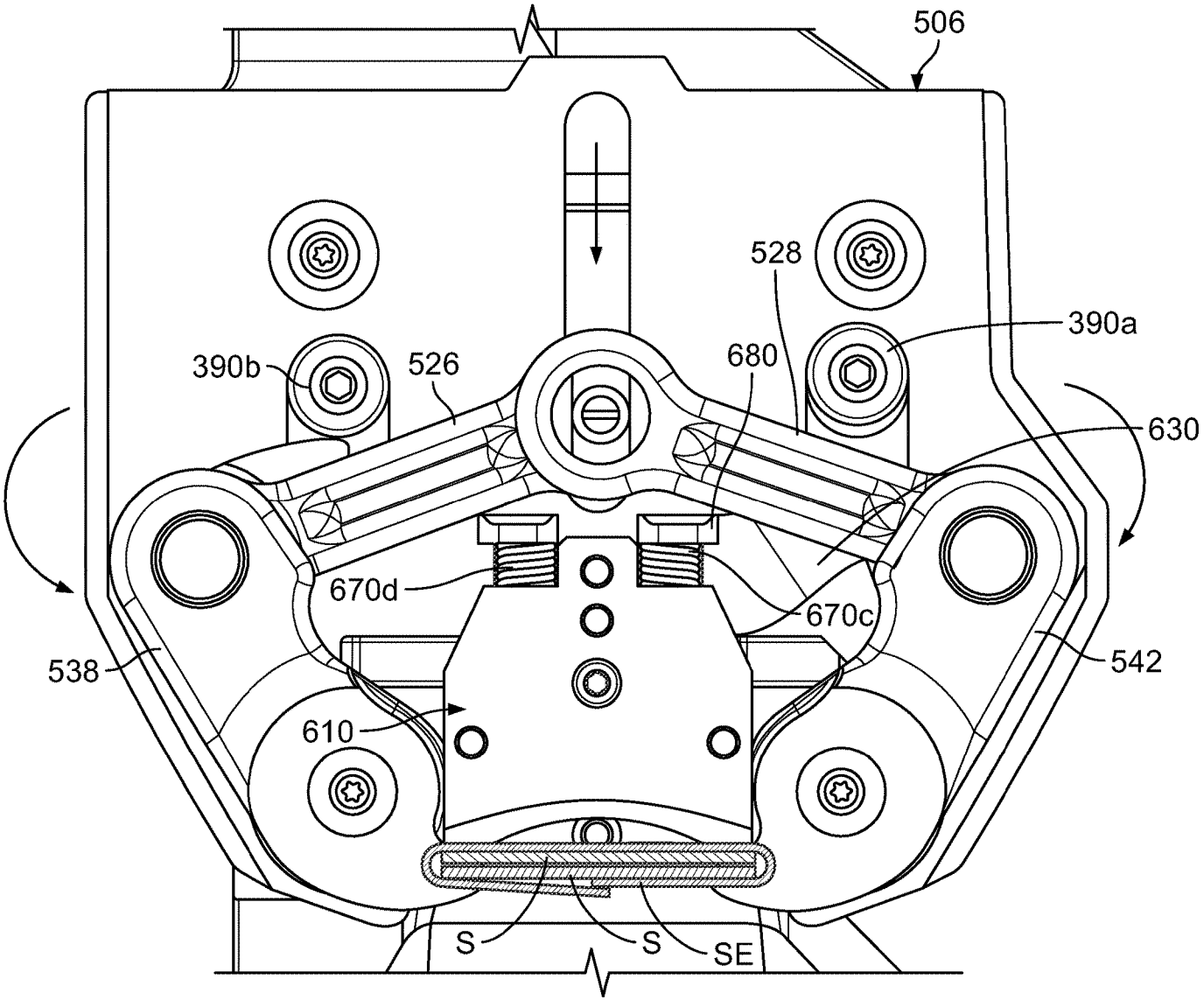
FIG. 16C is a front elevational view of part of the support of FIG. 2 and part of the sealing assembly of FIG. 5A with the sealing assembly in its sealing position and the jaws in their sealing positions after cutting notches in the seal element and the strap.

The respective lower portions of each of the first and second inner jaws 530 and 534 are pivotably connected by the connectors 516 and 518 to the front cover 502, the back cover 506, the inner jaw connector 546, the central jaw connector 550, and the outer jaw connector 566. The respective lower portions of each of the first and second outer jaws 538 and 542 are pivotably connected by the connectors 516 and 518 to the front cover 502, the back cover 506, the inner jaw connector 546, the central jaw connector 550, and the outer jaw connector 566. The pivotable connections enable the first inner and outer jaws 530 and 538 to pivot relative to the front and back covers 502 and 506 and the jaw connectors 546, 550, and 566 about longitudinal axis (not shown) of the connector 516 between respective home positions (FIG. 16A) and sealing positions (FIG. 16C). The pivotable connections enable the second inner and outer jaws 534 and 546 to pivot relative to the front and back covers 502 and 506 and the jaw connectors 546, 550, and 566 about a longitudinal axis (not shown) of the connector 518 between respective home positions (FIG. 16A) and sealing positions (FIG. 16C).

Figure 8A:
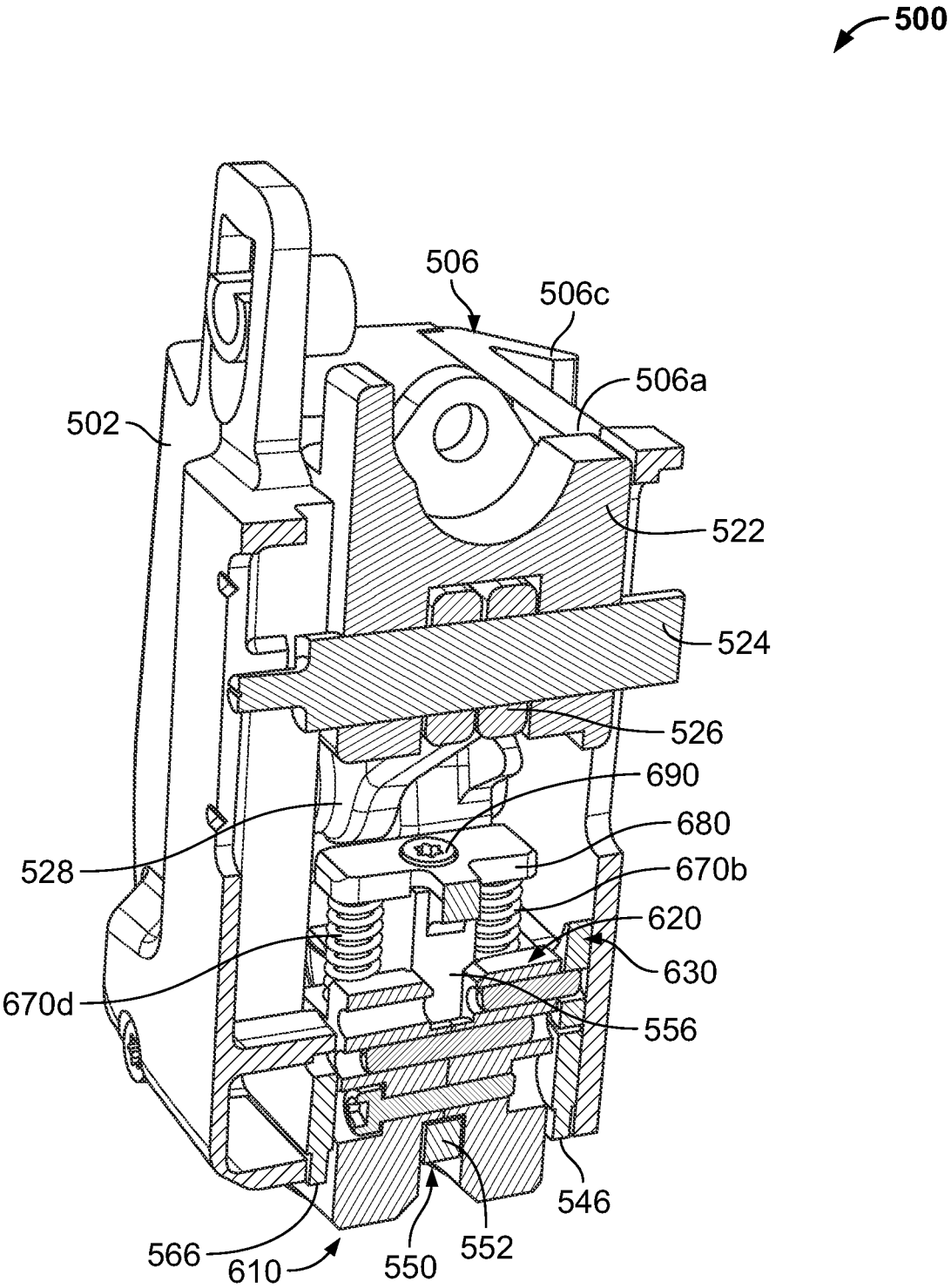
FIG. 8A is a cross-sectional perspective view of the sealing assembly of FIG. 5A taken substantially along line 8A-8A of FIG. 5A.
Figure 8B:
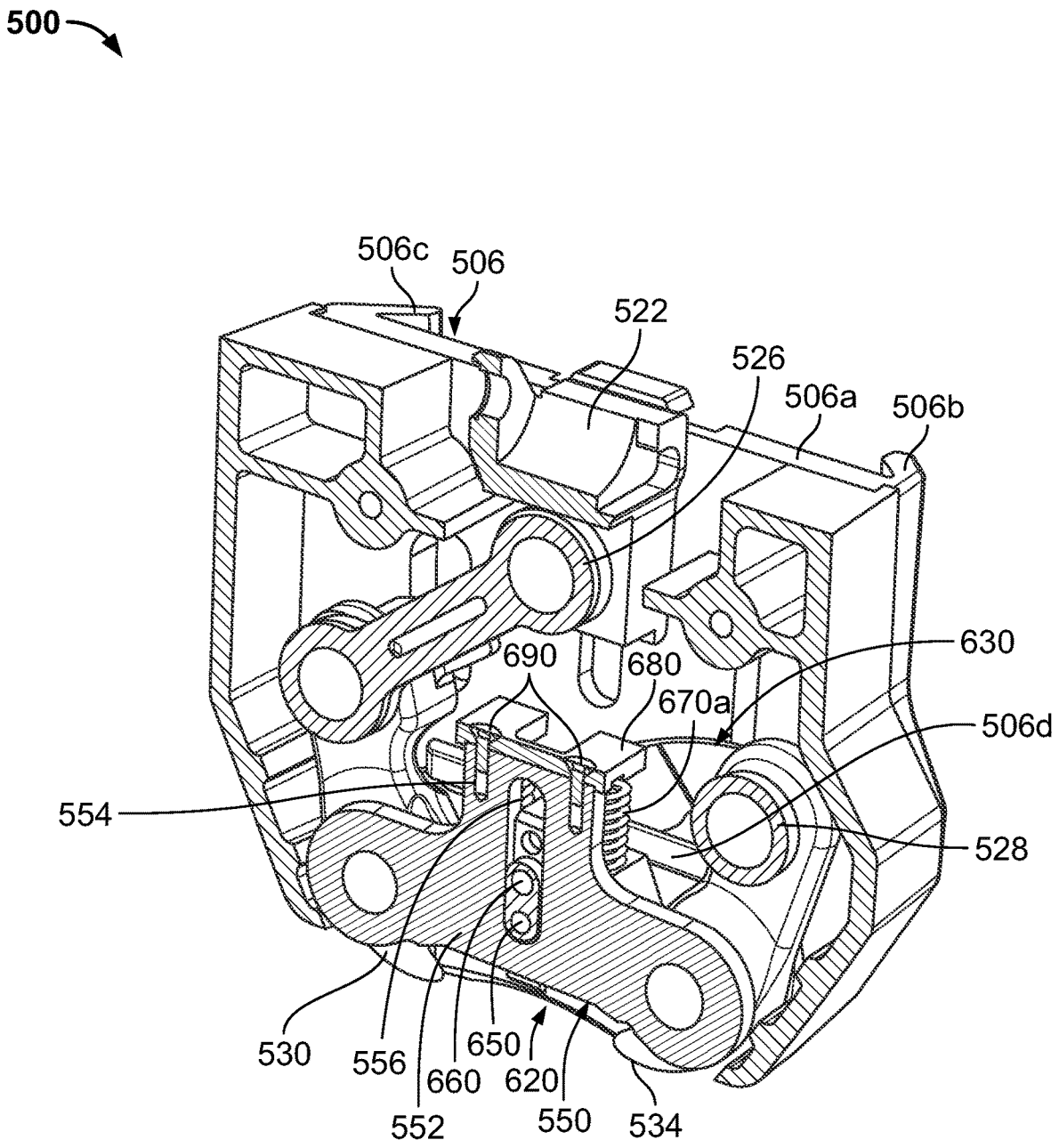
FIG. 8B is a cross-sectional perspective view of the sealing assembly of FIG. 5A taken substantially along line 8B-8B of FIG. 5A.
Figure 8C:
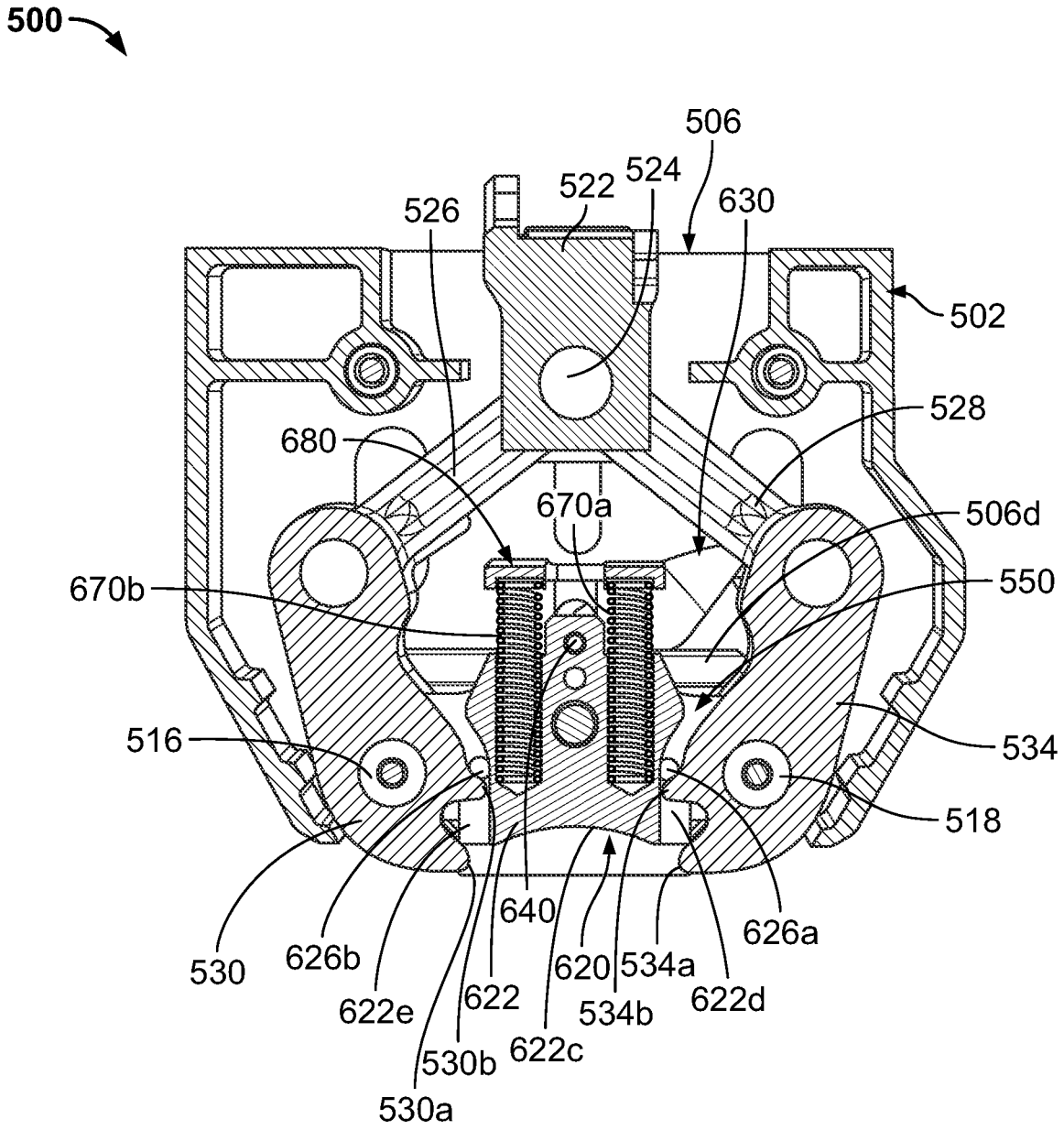
FIG. 8C is a cross-sectional perspective view of the sealing assembly of FIG. 5A taken substantially along line 8C-8C of FIG. 5A.

As best shown in FIGS. 5D and 8C, each jaw has a lower tooth that cuts a notch in the seal element and the overlapping portions of the strap during the sealing cycle and an upper tooth that engages an object blocker 605 of the object-blocking assembly 600 (described below) if the object blocker 605 is in its blocking position (described below) at the start of the sealing cycle and moves the object blocker 605 toward its retracted position as the jaws move to their respective sealing positions. This prevents the jaws from damaging the object blocker 605. More specifically, the first inner jaw 530 has a lower tooth 530*a* and an upper tooth 530*b*, the second inner jaw 534 has a lower tooth 534*a* and an upper tooth 534*b*, the first outer jaw 538 has a lower tooth 538*a* and an upper tooth 538*b*, and the second outer jaw 542 has a lower tooth 542*a* and an upper tooth 542*b*.

Figure 6A:
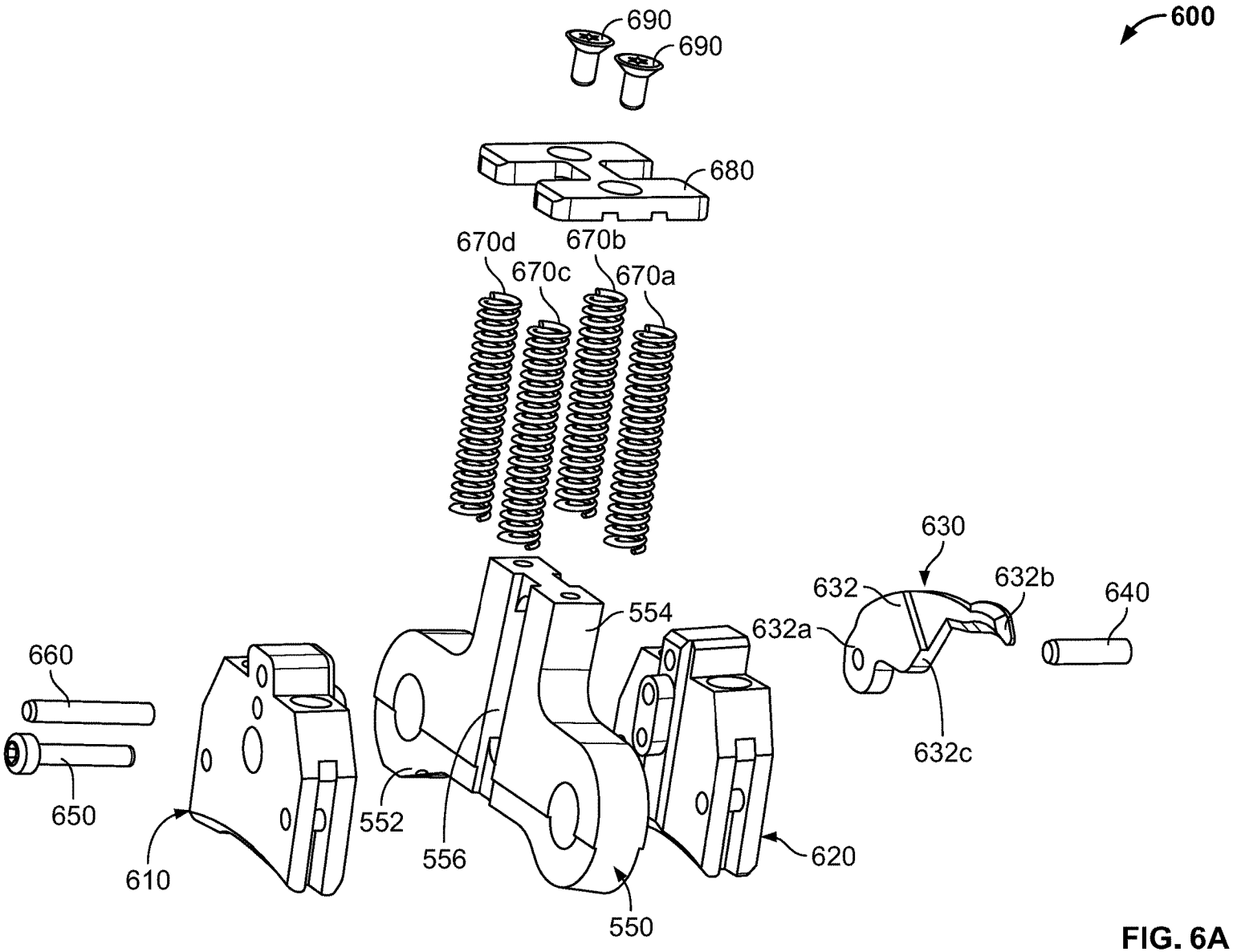
FIG. 6A is an exploded perspective view of the object-blocking assembly of the jaw assembly of the sealing assembly of FIG. 5A.
Figure 6B:
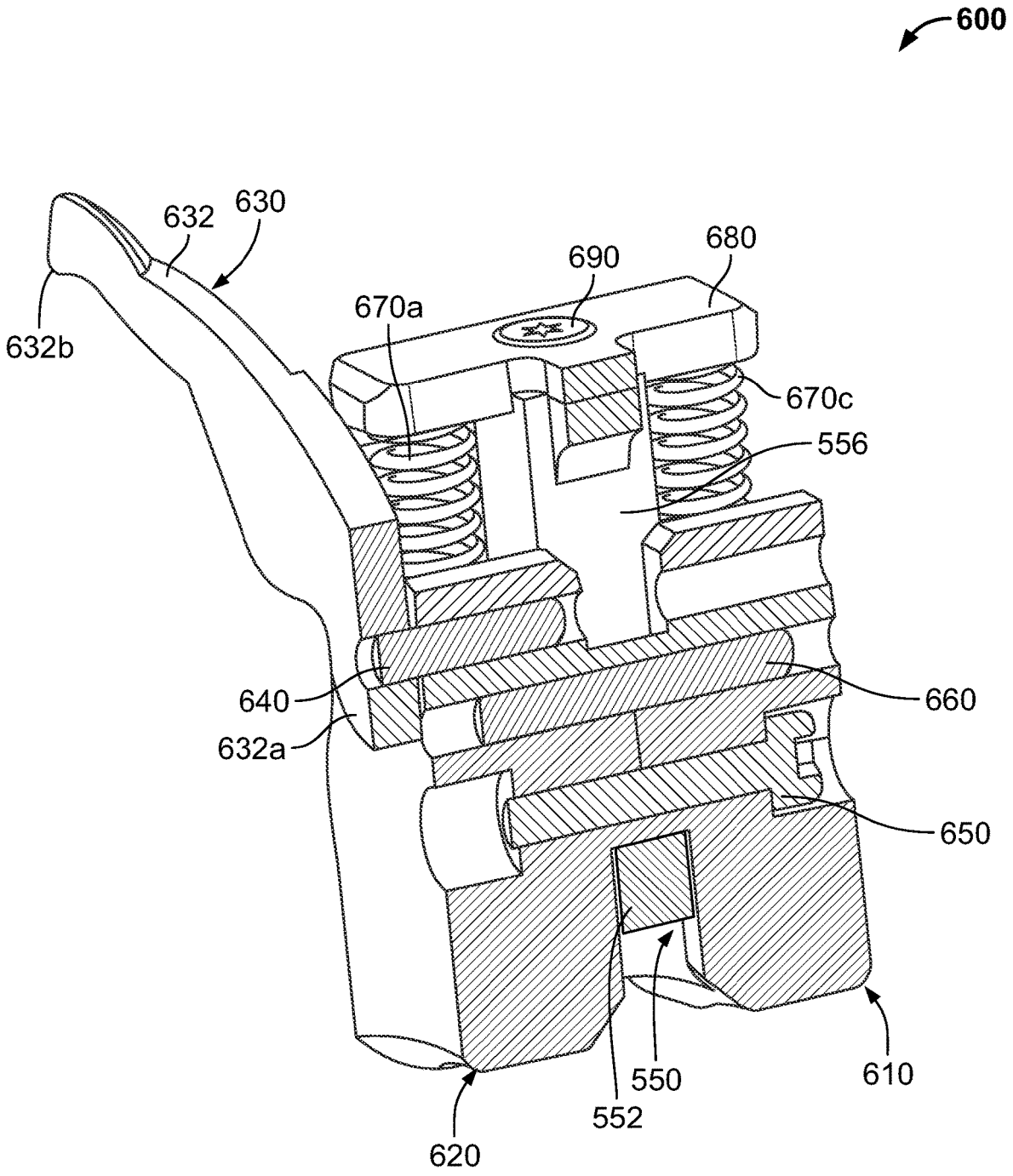
FIG. 6B is a cross-sectional perspective view of the object-blocking assembly of FIG. 6A taken substantially along the line 6B-6B of FIG. 5C.

The object-blocking assembly 600 is mounted to the jaw assembly 520 (and more particularly, to the central jaw connector 550) and configured to prevent objects from inadvertently entering the space between the first and second inner jaws 530 and 534 and the first and second outer jaws 538 and 542, sometimes referred to herein as the sealing-element-receiving space. This reduces the possibility of an object interfering with the operation of the strapping tool. This also prevents the jaws of the strapping tool from damaging the object (or vice-versa). As best shown in FIGS. 6A and 6B, the object-blocking assembly 600 includes an object blocker 605 formed from a first object blocker portion 610 and a second object blocker portion 620; an object-blocker-lift element 630; a lift-element-mounting pin 640; an object-blocker fastener 650; an object-blocker-mounting pin 660; multiple biasing elements 670*a*, 670*b*, 670*c*, and 670*d*; a biasing-element retainer 680; and fasteners 690.

Figure 7A:
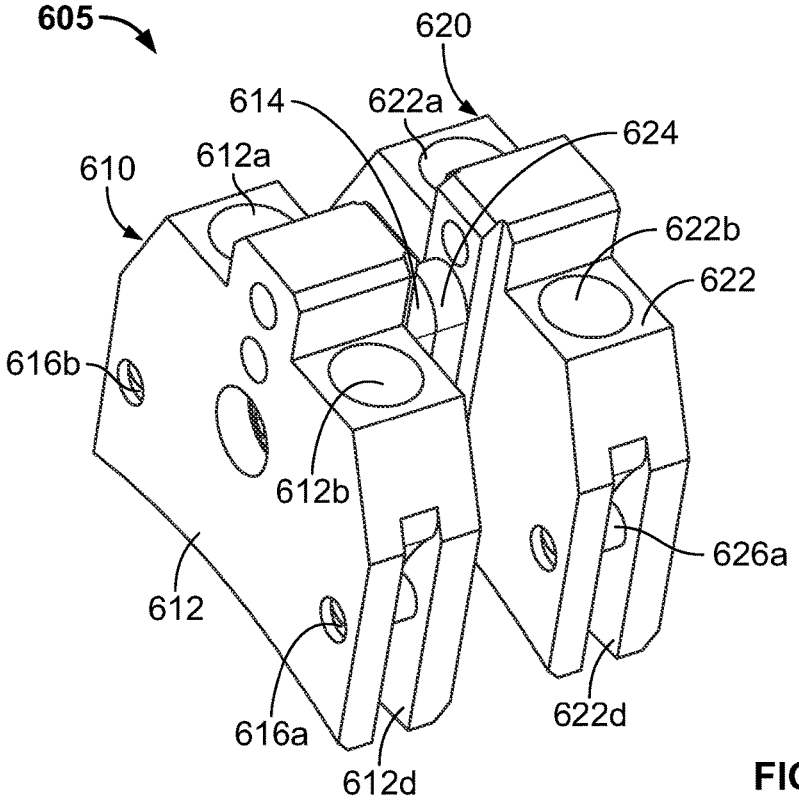
FIGS. 7A and 7B are perspective views of an object blocker of the object-blocking assembly of FIG. 6A.
Figure 7B:
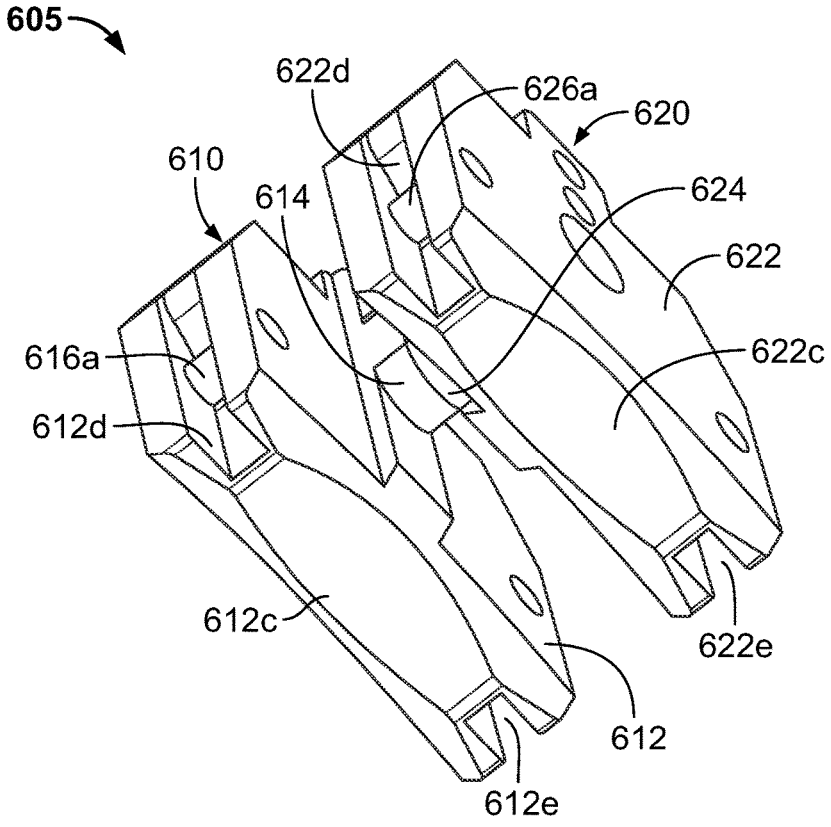

The object blocker 605 is best shown in FIGS. 7A and 7B and is formed from the first object blocker portion 610 and the second object blocker portion 620 joined by the object-blocker-mounting pin 660 and the object-blocker fastener 650. The first object blocker portion 610 includes a body 612 and a mating lug 614 extending from a rear surface of the body 612. The body 612 defines cylindrical biasing-element-receiving bores 612*a* and 612*b* that extend downward from an upper surface of the body 612. The biasing-element-receiving bores are sized, shaped, oriented, and otherwise configured to partially receive the biasing elements 670*d* and 670*c*, respectively. The underside of the body 612 includes a curved object-engaging surface 612*c* (though this surface may be planar in other embodiments). Opposing side surfaces of the body 612 define vertically extending slots 612*d* and 612*e*. Tooth-engaging pins 616*a* and 616*b* are received in bores defined in the body 612 from front to back and are positioned to extend across the slots 612*d* and 612*e*, respectively.

The second object blocker portion 620 includes a body 622 and a mating lug 624 extending from a front surface of the body 622. The body 622 defines cylindrical biasing-element-receiving bores 622*a* and 622*b* that extend downward from an upper surface of the body 622. The biasing-element-receiving bores are sized, shaped, oriented, and otherwise configured to partially receive the biasing elements 670*b* and 670*a*, respectively. The underside of the body 622 includes a curved object-engaging surface 622*c* (though this surface may be planar in other embodiments). Opposing side surfaces of the body 622 define vertically extending slots 622*d* and 622*e*. Tooth-engaging pins 626*a* and 626*b* are received in bores defined in the body 612 from front to back and are positioned to extend across the slots 622*d* and 622*e*, respectively.

The object blocker 605 is slidably mounted to the central jaw connector 550. More specifically, as best shown in FIGS. 6A and 6B, the central jaw connector 550 includes a body 552 and a neck 554 extending upward from a center of the body 552. The body 552 and the neck 554 define an object-blocker-mounting slot 556 therethrough. The object blocker 605 is assembled such that the mounting elements 614 and 624, the object-blocker fastener 650, and the object-blocker-mounting pin 660 extend through the object-blocker-mounting slot 556. After assembly, the object blocker 605 is vertically movable relative to the central jaw connector 550 (and constrained by the size of the object-blocker-mounting slot 556) between a (upper) retracted position (FIG. 9A) and a (lower) blocking position (FIG. 9B). The biasing-element retainer 680 is attached to the neck 554 of the central jaw connector 550 via the fasteners 690 to constrain the biasing elements 670*a*, 670*b*, 670*c*, and 670*d* in place in their respective biasing-element-receiving bores 622*b*, 622*a*, 612*b*, and 612*a* in the object blocker 605. The biasing elements 670 bias the object blocker 605 to its blocking position.

The object-blocker-lift element 630 is operably connected to the object blocker 605 to maintain the object blocker 605 in its retracted position when the sealing assembly 500 is in its home position to prevent the object blocker 605 from interfering with the seal element and the strap during strap insertion and strap tensioning. In this example embodiment and as best shown in FIGS. 6A and 6B, the object-blocker-lift element 630 is a lever arm that includes a body having a first (attached) end 632*a*, a second (free) end 632*b*, and a camming surface 632*c* extending therebetween. The object-blocker-lift element 630 is pivotably mounted to the second object blocker portion 620 at the first end 632*a* by the lift-element-mounting pin 640. The object-blocker-lift element 630 is pivotable relative to the object blocker 605 about a longitudinal axis of the lift-element-mounting pin 640 (not shown). As best shown in FIGS. 8B, 9A, and 9B, after being mounted to the object blocker 605, the object-blocker-lift element 630 is positioned between the lips 506*d* of the back cover 506 of the sealing assembly 500 and the first sealing-assembly-mounting element 390*a*. The camming surface 632*c* of the object-blocker-lift element 630 engages and rests upon one of the lips 506*d*. The object-blocker-lift element 630 is pivotable relative to the remainder of the support assembly 500 between a home position (FIG. 9B) and a lifting position (FIG. 9A).

The object-blocker-lift element 630 is positioned and configured such that the position of the object-blocker-lift element 630 in part controls the position of the object blocker 605. Specifically, when the object-blocker-lift element 630 is in the lifting position, the object-blocker-lift element 630 imparts a force on the object blocker 605 that overcomes the biasing force of the biasing elements 670 and maintains the object blocker 605 in its retracted position.

Conversely, when the object-blocker-lift element 630 is in its home position, it does not impart this force on the object blocker 605, and the object blocker 605 can move between its retracted and blocking positions. The biasing elements 670 bias the object-blocker-lift element 630 to its home position.

The position of the sealing assembly 500 controls the position of the object-blocker-lift element 630 (and therefore, in part, the position of the object blocker 605). As best shown in FIG. 9A, when the sealing assembly 500 is in its home position, the first sealing-assembly-mounting element 390*a* engages the object-blocker-lift element 630 and forces the object-blocker-lift element 630 into its lifting position. This in turn (and as explained above) forces the object blocker 605 into its retracted position. As the sealing assembly 500 moves from its home position to its sealing position, space is created between the lips 506 and the first sealing-assembly-mounting element 390*a*. As this space is created, the biasing elements 670 force the object blocker 605 to move toward its blocking position. Due to its pinned connection to the object blocker 605, this causes the object-blocker-lift element 630 to pivot so it remains in contact with the first sealing-assembly-mounting element 390*a*. FIG. 9B shows the object-blocker-lift element 630 and the object blocker 605 after they've reached their respective home position and blocking positions.

When the object blocker 605 is in its blocking position and the jaws 530, 534, 538, and 542 are in their home positions, the object blocker 605 and the jaws are in a blocking configuration. When these components are in the blocking configuration, the object blocker 605 occupies most of the seal-element-receiving space (not labeled) defined between the pair of jaws 530 and 538 and the pair of jaws 534 and 542 and below the jaw connectors 546, 550, and 566. As described in detail below, responsive to application of a force sufficient to overcome the biasing force of the biasing elements 670, the object blocker 605 moves from its blocking position to its retracted position and remains there until the force is removed. When in the retracted position, the object blocker 605 is not positioned in the seal-element-receiving space such that a seal element and strap can be positioned there for sealing.

If the sealing cycle (described below) is initiated with the object blocker 605 and the jaws 530, 534, 538, and 542 in the blocking configuration, the jaws are configured to move the object blocker 605 toward its retracted position to avoid damaging the jaw assembly 520 or any other component of the strapping tool 50 during the sealing cycle. Specifically, when the object blocker 605 is in its extended position, the upper teeth 530*b*, 534*b*, 538*b*, and 542*b* of the jaws 530, 534, 538, and 542 are adjacent to the pins 626*b*, 626*a*, 616*b*, and 616*a* of the object blocker 605, respectively. As the jaws begin pivoting from their respective home positions to their respective sealing positions, the upper teeth engage their respective pins. Continued movement of the jaws to their respective sealing positions causes the upper teeth to apply sufficient force to the pins to overcome the biasing force of the biasing elements 670 and move the object blocker 605 toward its retracted position. As this occurs, the lower teeth enter the slots defined in the sides of the object blocker 605.

One issue with certain known strapping tools that use jaws to crimp or notch the strap and (if applicable) the seal element is that a foreign object may (inadvertently) enter the space between the jaws instead of or in addition to the strap and (if applicable) the seal element. This is problematic for several reasons. The object may interfere with the operation of the strapping tool and cause the joint formed via the attachment of the overlapped strap portions to one another to have suboptimal strength, which could lead to unexpected joint failure and product loss. Additionally, the object could damage the jaws and/or other components of the sealing assembly during the sealing process, which would require tool repairs and cause downtime. Further, the sealing assembly could damage or destroy the object.

The object-blocking assembly 600 solves this problem by ejecting foreign objects from and by preventing foreign objects from inadvertently entering the seal-element-receiving space between the jaws. Specifically, if a loose foreign object—such as the shaft of a screwdriver—is in the seal-element-receiving space between the jaws as the sealing assembly 500 reaches its sealing position, the object blocker 605 will force that object out of the seal-element-receiving space as the object blocker 605 moves from its retracted position to its blocking position. Once the object blocker 605 reaches its blocking position, minimal space exists between the object blocker 605 and the lower teeth of the jaws, thereby preventing foreign objects from entering the seal-element-receiving space between the jaws.

Although not shown here, a cutter is positioned in and movable within the recess in the back cover 506 (best shown in FIG. 5B) and mounted to the pivot pin 524. Movement of the pivot pin 524 downwards causes the pivot pin 524 to force the cutter downward to cut the strap from the strap supply, and movement of the pivot pin 524 back upward causes the cutter to move back upward.

The drive assembly 700, which is best shown in FIGS. 3A-3D and 12A-14H, is operably connected to and configured to rotate the tension wheel 440 to tension the strap and is operably connected to the sealing assembly 500 to attach the overlapping portions of the strap to one another. The drive assembly 700 includes an actuator 710, a first transmission 720, a second transmission 730, a first belt 740, a third transmission 750, a second belt 760, and a conversion assembly 800.

In this example embodiment, the actuator 710 is a motor (and referred to herein as the motor 710), and particularly a brushless direct-current motor that includes a motor output shaft (not labeled) (though the motor 710 may be any other suitable type of motor in other embodiments). The motor 710 is operably connected to (via the motor output shaft) and configured to drive the first transmission 720, which (as described below) is configured to selectively transmit the output of the motor 710 to either the tensioning assembly 400 or the sealing assembly 500. In other embodiments, the strapping tool includes separate tensioning and sealing actuators respectively configured to actuate the tensioning assembly and the sealing assembly rather than a single actuator configured to actuate both.

The first transmission 720 includes any suitable gearing and/or other components that are configured to selectively transmit the output of the motor 710 to the second transmission 730 via the first belt 740 and to the third transmission 750 via the second belt 760. More specifically, the first transmission 720 is configured such that: (1) rotation of the motor output shaft in a first rotational direction causes the first transmission 720 to transmit the output of the motor 710 to the second transmission 730 via the first belt 740 and not to the third transmission 750; and (2) rotation of the motor output shaft in a second rotational direction opposite the first rotational direction causes the first transmission 720 to transmit the output of the motor 710 to the third transmission 750 via the second belt 760 and not to the second transmission 730. Thus, in this embodiment, a single motor (the motor 710) is configured to actuate both the tensioning and sealing assemblies 400 and 500.

To accomplish this selective transmission of the motor output, the first transmission 720 includes a first belt pulley (or other suitable gearing component) (not labeled) mounted on a first freewheel (not labeled) that is mounted on the motor output shaft and a second belt pulley (or other suitable gearing component) (not labeled) mounted on a second freewheel (not labeled) that is mounted on the motor output shaft. The first belt pulley is operatively connected (via the first belt 740) to the second transmission 730, and the second belt pulley is operatively connected (via the second belt 760) to the third transmission 750. When the motor output shaft rotates in the first direction: (1) the first freewheel and the first belt pulley rotate with the motor output shaft, thereby transmitting the motor output to the second transmission 730 via the first belt 740; and (2) the motor output shaft rotates freely through the second freewheel, which does not rotate the second belt pulley. Conversely, when the motor output shaft rotates in the second direction: (1) the second freewheel and the second belt pulley rotate with the motor output shaft, thereby transmitting the motor output to the third transmission 750 via the second belt 760; and (2) the motor output shaft rotates freely through the first freewheel, which does not rotate the first belt pulley. This is merely one example embodiment of the first transmission 720, and it may include any other suitable components in other embodiments.

The second transmission 730 is configured to transmit the output of the first transmission 720 to the tensioning assembly 400 to cause the tensioning wheel 440 to rotate. More particularly, the second transmission 730 is configured to transmit the output of the first transmission 720 to the tensioning-assembly gearing of the tensioning assembly 400 to rotate the tension shaft and the tension wheel 440 thereon. Accordingly, the motor 710 is operatively coupled to the tension wheel 440 (via the first transmission 720, the first belt 740, the second transmission 730, the tensioning-assembly gearing, and the tension shaft) and configured to rotate the tension wheel 440. The second transmission 730 may include any suitable components arranged in any suitable manner.

The third transmission 750 is configured to transmit the output of the first transmission 720 to the conversion assembly 800. The third transmission 750 may include any suitable components, such as one or more gears and one or more shafts arranged in any suitable manner.

The conversion assembly 800 is configured to transmit the output of the third transmission 750 to the sealing assembly 500 to carry out the sealing cycle, which includes: moving the sealing assembly from its home position to its sealing position, causing the jaws of the sealing assembly to move from their home positions to their sealing positions to cut notches in the seal element and the strap, causing the jaws to move back to their home positions to release the notched seal element and strap, and moving the sealing assembly back to its home position. In doing so, in this embodiment the conversion assembly 800 is configured to convert rotational output (the rotation of shafts and gears) to linear output (the reciprocating translational movement of a coupler).

The conversion assembly 800 is best shown in FIGS. 12A-14H and includes a drive wheel 810, a bearing 815, a tubular shaft 820, a linkage mount 830, a retaining ring 835, a conversion-assembly linkage 840, and an effective-length-changing device 850.

Figure 12A:
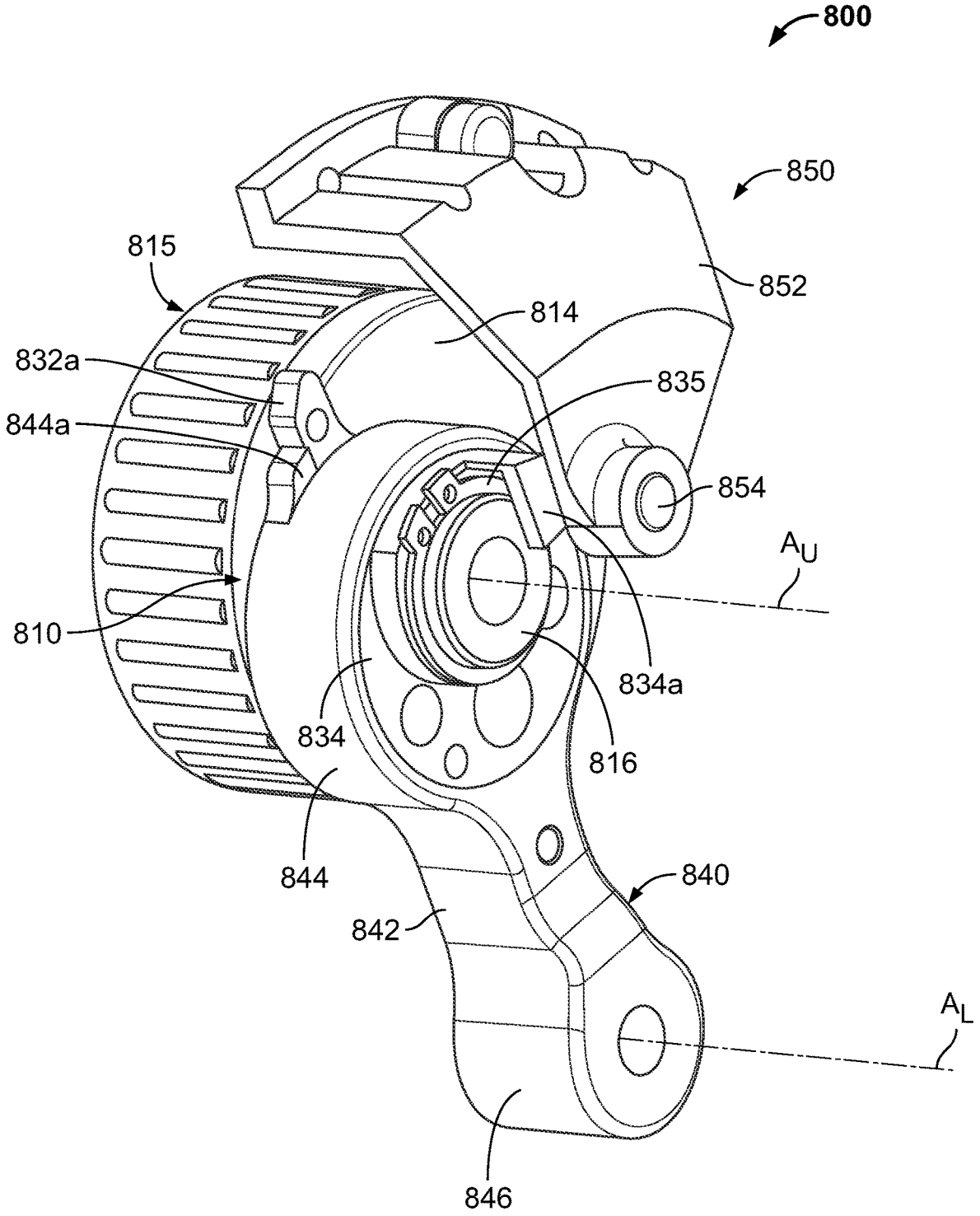
FIG. 12A is a perspective view of the conversion assembly of the drive assembly of the working assembly of FIG. 3A.
Figure 12B:
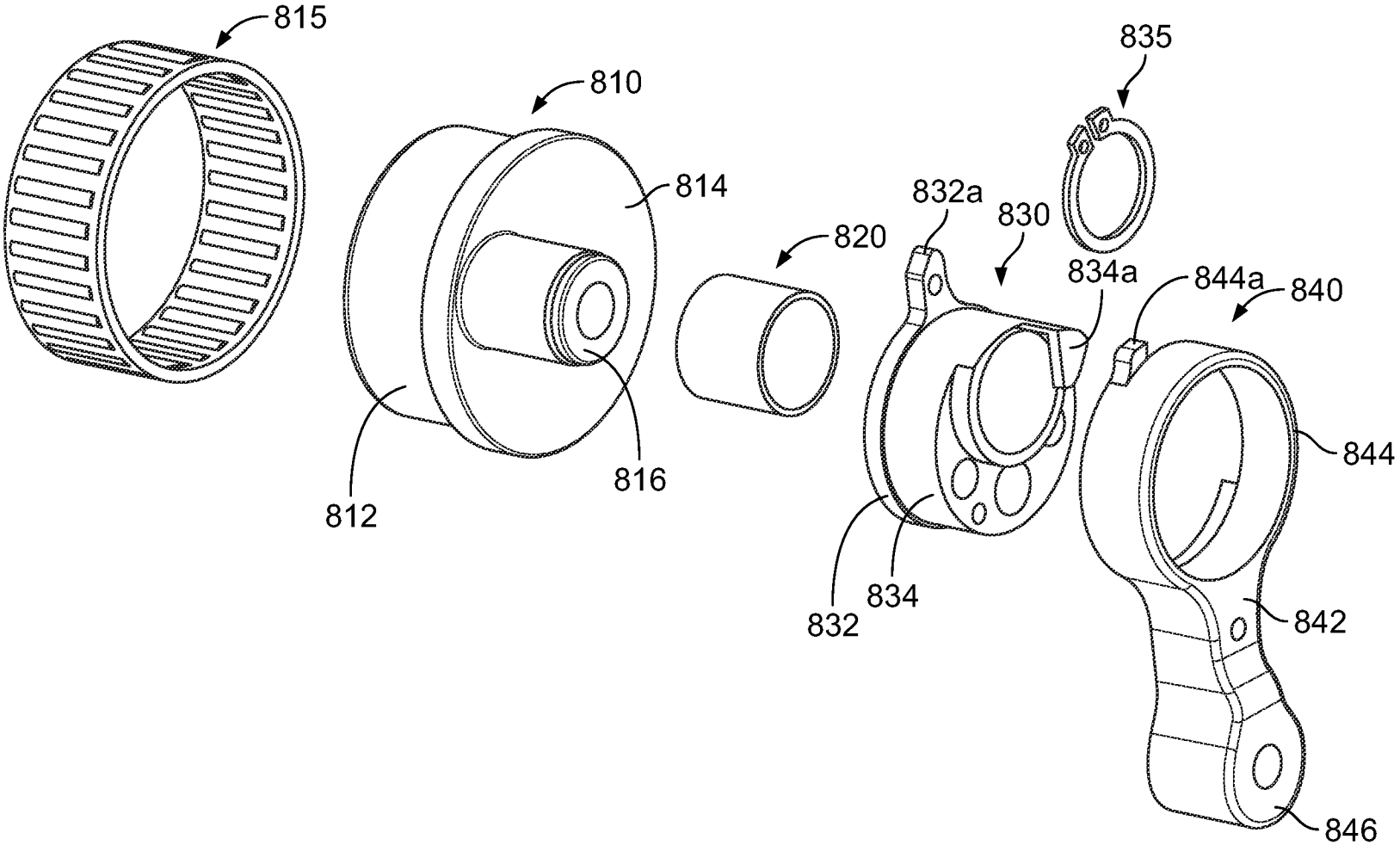
FIG. 12B is an exploded perspective view of a movable first portion of the conversion assembly of FIG. 12A.

As best shown in FIG. 12B, the drive wheel 810 includes a cylindrical base 812 and a disc-shaped head 814 centered at one end of the base 812. A linkage-drive shaft 816 extends from the head 814 near the perimeter of the head 814 (i.e., radially spaced from the longitudinal axis of the head 814). The linkage mount 830 includes a disc-shaped base 832 including a radially-outwardly extending first finger 832*a*. A disc-shaped head 834 is centered on one end of the base 832. A drive-shaft-mounting opening (not labeled) is defined through the base 832 and the head 834, and is radially spaced from the common longitudinal axis of the base 832 and the head 834. A radially-inwardly extending second finger 834*a* extends in front of the drive-shaft-mounting opening. The linkage 840 includes a body 842 with an annular head 844 at one end and a foot 846 at the other end. A stop tab 844*a* extends radially outwardly from the head 844.

As best shown in FIG. 3A, the base 812 of the drive wheel 810 is journaled in the drive-and-conversion-assembly-mounting element 340 of the support 300 via the bearing 815, which is a roller bearing in this example embodiment, so the drive wheel 810 can rotate relative to the support 300 about a drive-wheel rotational axis (not shown). As best shown in FIG. 12A, the tubular shaft 820 is positioned on the linkage-drive shaft 816, and the tubular shaft 820 is received in the drive-shaft-mounting opening in the linkage mount 830 to mount the linkage mount 830 to the drive wheel 810. The retaining ring 835 is inserted into a groove (not labeled) defined around the perimeter of the linkage-drive shaft 816 to retain these components in place. Once mounted, the linkage mount 830 is rotatable relative to the drive wheel 810 about a rotational axis $A_U$ (FIG. 12A), which is coaxial with the longitudinal axis of the linkage-drive shaft 816. The head 834 of the linkage mount 830 is received in the head 844 of the linkage 840 to mount the linkage 840 to the linkage mount 830. Once mounted, the linkage 840 is rotatable relative to the linkage mount 830 about a central axis (not shown) of the head 844.

Figure 12C:
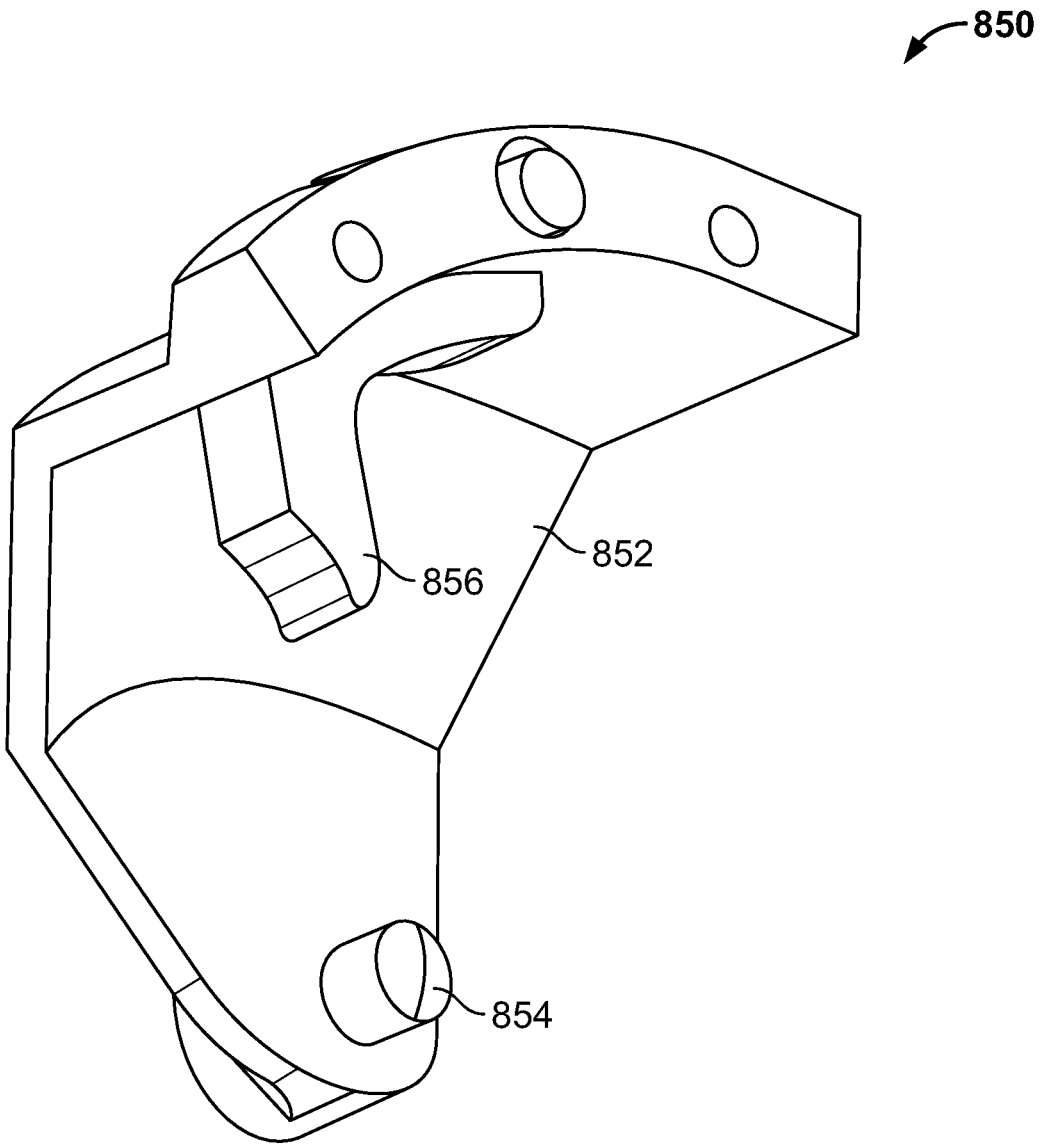
FIG. 12C is a perspective view of a stationary second portion of the conversion assembly of FIG. 12A.

As best shown in FIGS. 12A and 12C, the effective-length-changing device 850 includes a mounting bracket 852, a first stationary finger 856, and a second stationary finger 854. As best shown in FIG. 3A, the effective-length-changing device 850 is fixedly connected to the drive-and-conversion-assembly-mounting element 340 of the support 300 so the effective-length-changing device 850 (and particularly the first and second stationary fingers 854 and 856) is stationary relative to the drive wheel 810, the linkage mount 830, and the linkage 840.

Figure 13B:
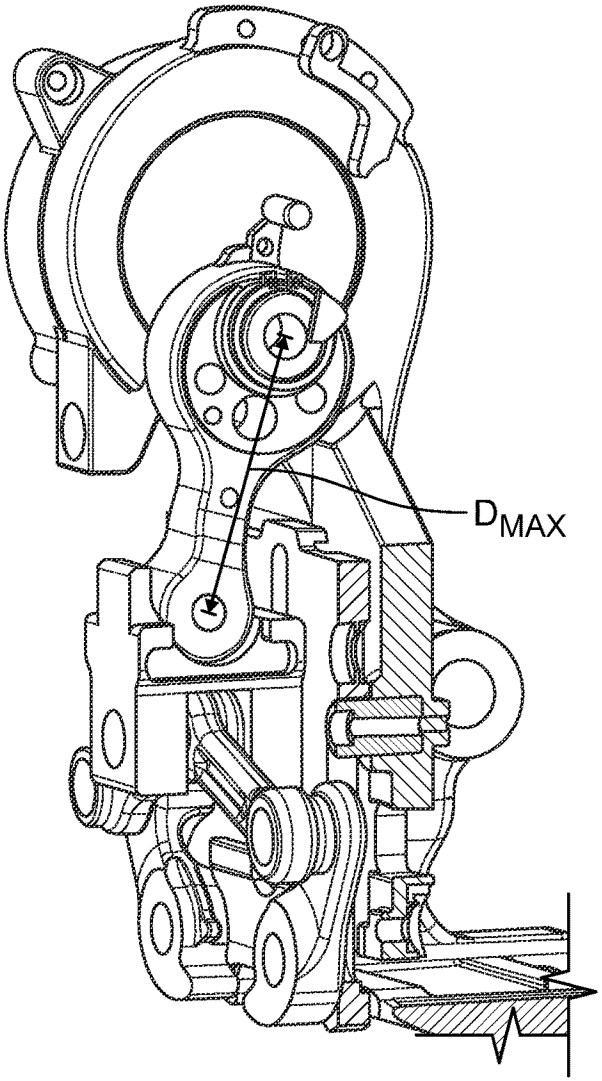
FIG. 13B is a cross-sectional perspective view of part of the support of FIG. 2, part of the sealing assembly of FIG. 5A, and part of the conversion assembly of FIG. 12A in which the effective length of the linkage of the conversion assembly is at a maximum.
Figure 13A:
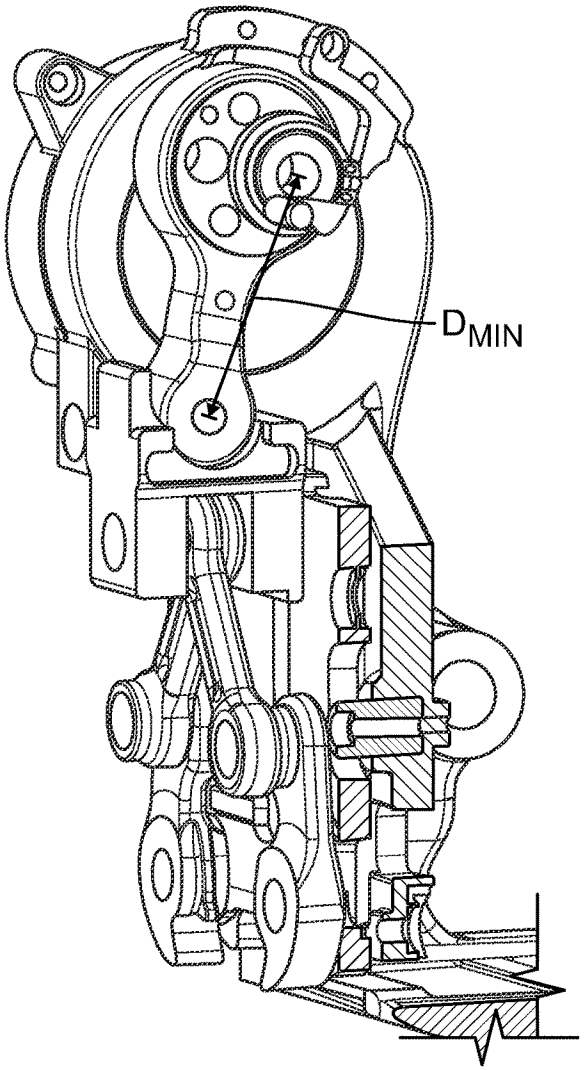
FIG. 13A is a cross-sectional perspective view of part of the support of FIG. 2, part of the sealing assembly of FIG. 5A, and part of the conversion assembly of FIG. 12A in which the effective length of the linkage of the conversion assembly is at a minimum.

Although not shown, the third transmission 750 is operably connected to the drive wheel 810 (such as via a shaft and suitable gearing) and configured to rotate the drive wheel 810 about the drive-wheel rotational axis. The foot 846 of the linkage 840 is pivotably connected to the coupler 522 of the sealing assembly 500, as best shown in FIGS. 3A, 13A, and 13B, so the linkage 840 is pivotable relative to the coupler 522 about an axis $A_L$ (FIG. 12A). Accordingly, the motor 710 is operatively coupled to the sealing assembly 500 (via the third transmission 750, the second belt 760, and the conversion assembly 800) and configured to control the sealing assembly 500 to carry out a sealing cycle, as described below.

More specifically, rotation of the motor output shaft of the motor 710 in the second rotational direction causes rotation of the second belt pulley of the first transmission 720. The second belt 760 transmits the output of the first transmission 720 (in this instance, the rotation of the second belt pulley) to the third transmission 750, which in turn transmits the output of the first transmission 720 to the conversion assembly 800. More specifically, the third transmission 750 transmits the output of the first transmission 720 to the drive wheel 810 of the conversion assembly 800, which causes the drive wheel 810 to rotate about the drive-wheel rotational axis, carrying the head 844 of the linkage 840 with it.

The drive wheel 810 has a home position (and may be detected at that home position by a home position sensor that communicates this to the controller 1300). As best shown in FIG. 13A, when the drive wheel 810 is in the home position: the foot 846 of the linkage 840 is at its home position (which is its uppermost position in this example embodiment), the sealing assembly 500 is in its home position, and the jaws 530, 534, 538, and 542 are in their respective home positions in preparation for sealing. Upon initiation of the sealing cycle, the drive wheel 810 begins rotating (counter-clockwise in this example embodiment) from its home position to its sealing position (shown in FIG. 13B). As the drive wheel 810 rotates, the linkage 840 imparts a force on the coupler 522 that moves the sealing assembly 500 toward its sealing position. After the sealing assembly 500 reaches its sealing position, continued rotation of the drive wheel 810 causes the link 840 to force the coupler 522 to move toward the jaws relative to the front and back plates 502 and 506 of the sealing assembly 500 (guided by the pivot pin 524 received in the slots defined in the front and back plates). This causes downward movement of the upper ends of first and second upper linkages 526 and 528, which causes outward movement of the lower ends of the first and second upper linkages 526 and 528. This causes outward movement of the upper portions of the jaws. This causes inward movement of the lower portions of the jaws. In other words, this causes the jaws to pivot from their respective home positions to their respective sealing positions. The jaws are in their respective sealing positions when the foot 846 of the linkage 840 reaches its sealing position (which is its lowermost position in this example embodiment). Continued rotation of the drive wheel 810 back to its home position reverses the above movements: the jaws move from their sealing positions back to their home positions, and afterwards the sealing assembly moves back to its home position.

The components of the conversion assembly 800 are sized, shaped, positioned, oriented, and otherwise configured to change the effective length of the linkage 840—which is the distance D between the axes $A_U$ and $A_L$—during the sealing cycle to rapidly move the sealing assembly 500 toward its sealing position (by increasing the effective length of the linkage 840) and, after notching, back toward its home position (by decreasing the effective length of the linkage 840). The minimum effective length of the linkage 840 is $D_{MIN}$, and the maximum effective length of the linkage 840 is $D_{MAX}$, as shown in FIGS. 13A and 13B.

Figure 14A:
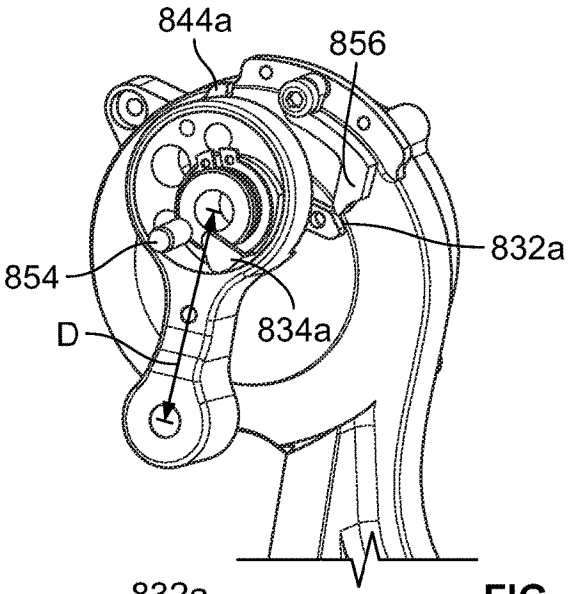
FIGS. 14A-14H are perspective views of part of the conversion assembly of FIG. 12A illustrating how the effective length of the linkage of the conversion assembly varies during the sealing cycle.
Figure 14B:
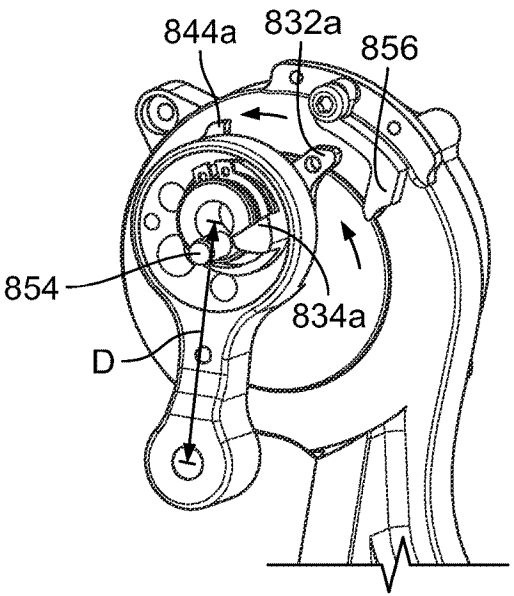
Figure 14C:
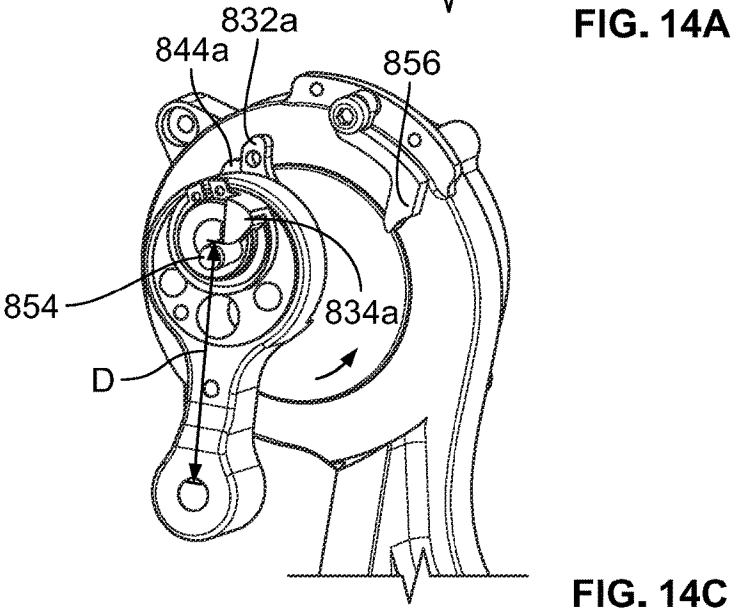

FIGS. 14A-14H illustrate how the components of the conversion assembly 800 cooperate to change the effective length of the linkage 840 during the sealing cycle. At the start of the sealing cycle, the drive wheel 810 and the foot 846 of the linkage 840 are at their respective home positions, as shown in FIG. 14A. The drive wheel 810 begins rotating from its home position to its sealing position, causing the second finger 834*a* of the head 834 of the linkage mount 830 to contact the second stationary finger 854 of the effective-length-changing device 850. As the drive wheel 810 continues to rotate, the engagement between the second finger 834*a* and the second stationary finger 854 causes the linkage mount 830 to remain stationary as the drive wheel 810 and the linkage 840 continue to rotate relative to the linkage mount 830. As shown in FIG. 14B, as this occurs it causes the first finger 832*a* to rotate relative to the linkage 840 toward the stop tab 844*a* of the head 844 of the linkage 840. This relative rotation of the linkage mount 830 relative to the linkage 840 combined with the eccentric mounting of the linkage mount 830 to the drive wheel 810 causes the effective length of the linkage 840 to increase from $D_{MIN}$. As shown in FIG. 14C, just as the effective length of the linkage 840 reaches its maximum $D_{MAX}$ and the first finger 832*a* reaches the stop tab 844*a*, the second finger 834*a* disengages the second stationary finger 854. In this example embodiment, the sealing assembly 500 reaches its sealing position just as the effective length of the linkage 840 reaches its maximum $D_{MAX}$.

Figure 14D:
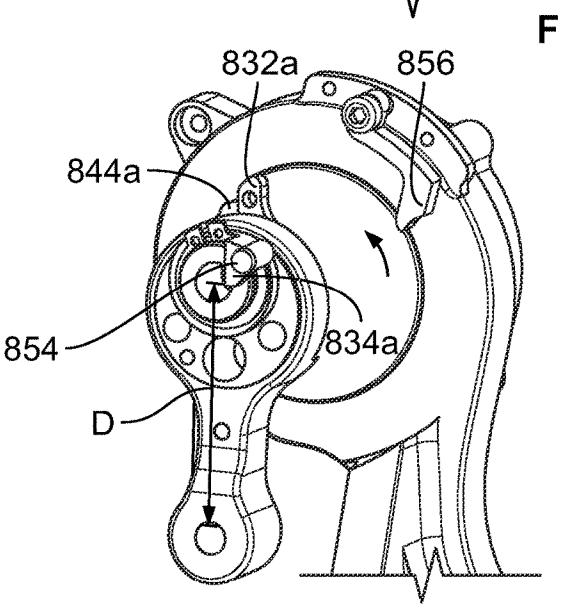
Figure 14F:
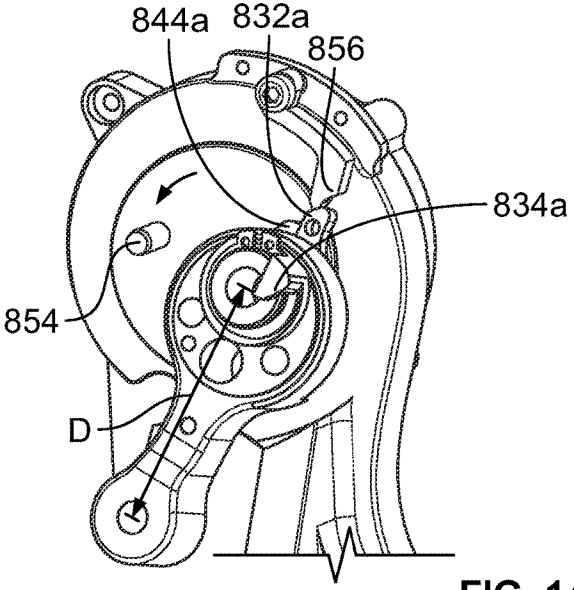
Figure 14H:
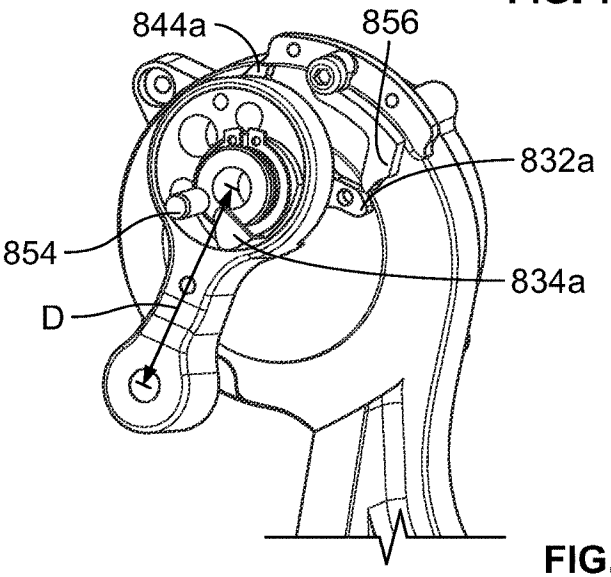
Figure 14E:
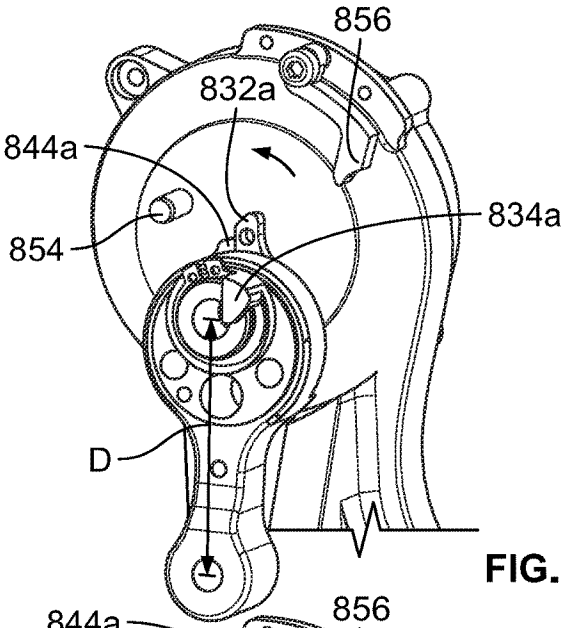
Figure 14G:
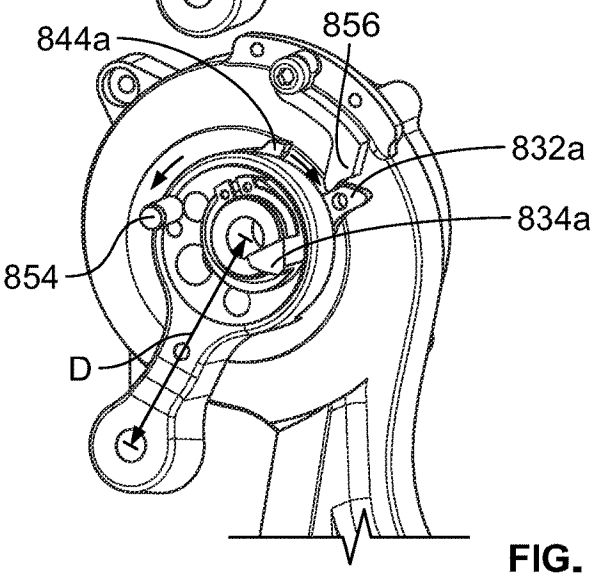

After the effective length of the linkage 840 reaches $D_{MAX}$, as the drive wheel 810 continues to rotate toward its sealing position, the linkage 840 remains the same effective length and the jaws begin moving from their home positions to their sealing positions, as shown in FIG. 14D. FIG. 14E shows the drive wheel 810 at its sealing position, at which point the jaws have also reached their sealing positions and notched the seal element and the strap. Afterwards, continued rotation of the drive wheel 810 brings the first finger 832*a* into contact with the first stationary finger 856 of the effective-length-changing device 850, as shown in FIG. 14F. As the drive wheel 810 continues to rotate back to its home position, the engagement between the first finger 832*a* and the first stationary finger 856*a* causes the linkage mount 830 to remain stationary as the drive wheel 810 and the linkage 840 continue to rotate relative to the linkage mount 830. As shown in FIG. 14G, as this occurs it causes the first finger 832*a* to rotate relative to the linkage 840 away from the stop tab 844*a* of the head 844 of the linkage 840. This relative rotation of the linkage mount 830 relative to the linkage 840 combined with the eccentric mounting of the linkage mount 830 to the drive wheel 810 causes the effective length of the linkage 840 to decrease from $D_{MAX}$. As shown in FIG. 14H, just as the effective length of the linkage 840 reaches its minimum $D_{MIN}$, the first finger 832*a* disengages the first stationary finger 856. In this example embodiment, the sealing assembly 500 reaches its home position just as the effective length of the linkage 840 reaches its minimum $D_{MIN}$.

Varying the effective length of the linkage 840 during the sealing cycle provides several benefits compared to prior art tools with linkages having a fixed effective length. Since the sealing assembly 500 reaches its sealing position shortly after the start of the sealing cycle, more of the travel of the linkage-drive shaft 816 as it rotates from its home position to its sealing position is used to cut the notches in the seal element and the strap (as compared to prior art tools). This means that less force is required to cut the notches. In turn, the components of the jaws assembly 520—such as the jaws, gears, links, and the like—are lighter (and in some instances smaller) than those of prior art tools, rendering this tool lighter (and in some instances more compact) and therefore easier to handle. Since less force is required to cut the notches, the amount of torque the motor must provide is less than in prior art tools, meaning that the motor draws less current than in prior art tools and is more efficient. And this also allows the motor to run faster and therefore increase the speed of the sealing cycle as compared to prior art tools.

The gate assembly 1000, which is best shown in FIGS. 10A-11B, is configured to facilitate easy insertion of the strap and is adjustable to accommodate straps of differing thicknesses. The gate assembly 1000 includes a gate 1010 and multiple linkages 1012, 1014, and 1016.

The gate 1010 is slidably received in the gate-receiving recess 350 of the body 310 of the support 300 and retained in that recess via a retaining bracket (not shown for clarity). A strap-receiving opening (not labeled) is defined between the bottom of the gate 1010 and the top surface of the foot 320 of the support 300. The gate 1010 is movable relative to the support 300 between a home position (FIGS. 10A and 10B) and a retracted position (FIGS. 11A and 11B). When in the home position, the gate 1010 is positioned relative to the foot 320 so the height $H_1$ of the strap-receiving opening is equal to or just larger than the thickness of the particular strap to-be-tensioned and sealed. When in the retracted position, the gate 1010 is positioned relative to the foot 320 so the height $H_2$ of the strap-receiving opening larger than the height $H_1$. The position of the tensioning assembly 400 controls the position of the gate 1010.

The linkage 1016 is fixedly connected at one end to the tensioning assembly 400 and pivotably connected at the other end to one end of the linkage 1014. The other end of the linkage 1014 is pivotably connected to one end of the linkage 1012. The other end of the linkage 1012 is fixedly connected to the gate 1010. The linkages 1012, 1014, and 1016 are sized, shaped, positioned, oriented, and otherwise configured such that: (1) when the tensioning assembly 400 is in the strap-tensioning position, the gate 1010 is in its home position (and the strap-receiving opening has the height $H_1$); and (2) when the tensioning assembly 400 is in its strap-insertion position, the gate 1010 is in its retracted position (and the strap-receiving opening has the height $H_2$). More specifically, when the tensioning assembly 400 is pivoted from the strap-tensioning position to the strap-insertion position, the linkage 1016 is pivoted counter-clockwise. This causes the linkage 1014 to pivot clockwise, which forces the linkage 1012 to move upward and carry the gate 1010 with it.

One issue with certain known strapping tools is that it is difficult to insert the strap into the strapping tools. These known strapping tools include a gate positioned forward of the tensioning wheel so the seal engages the gate during the tensioning cycle and so the gate prevents the seal from contacting the tensioning wheel. The gate is fixed in place and positioned so the strap-receiving opening defined between the bottom of the gate the top of the foot of the strapping tool (on which the strap is positioned during operation) has the same height as or a height slightly larger than the thickness of the strap. This prevents the strap from moving up and down during operation of the strapping tool. The problem is that it is difficult and time-consuming for operators to align the strap with the strap-receiving opening to insert the strap into the strap-receiving opening that has a height that at best is slightly larger than the strap is thick.

The gate assembly 1000 of the present disclosure solves this problem by increasing the height of the strap-receiving opening when the tensioning assembly 400 is moved to its strap-insertion position. In other words, the tensioning assembly 400 is coupled to the gate 1010 (via the linkages) so movement of the tensioning assembly 400 from the strap-tensioning position to the strap-insertion position causes the gate 1010 to move from its home position to its retracted position to enlarge the strap-receiving opening. This makes it easier for the operator to insert the strap into the strap-receiving opening, which streamlines operation of the strapping tool.

The position of the gate 1010 relative to the foot 320 is also variable. Specifically, the gate 1010 can be fixed to the linkage 1012 in any of several different vertical positions. By changing the vertical position of the gate 1010 relative to the linkage 1012, the operator can vary the height $H_1$ of the strap-receiving opening when the gate 1010 is in the home position. For instance, in this embodiment, the linkage 1012 is connected to the gate 1010 via one or more screws. The screws extend through elongated slots that extend along the length of the gate 1010. To change the height $H_1$ of the strap-receiving opening when the gate 1010 is in its home position, the operator loosens the screws, slides the gate 1010 up or down relative to the linkage 1012 (taking advantage of the slots), and re-tightens the screws.

One issue with certain known strapping tools is that it is time-consuming to reconfigure the strapping tools for use with straps of different thicknesses. To reconfigure a strapping tool for use with a strap having a different thickness, the operator must replace the existing gate with another gate sized for use with the new strap (e.g., a gate that is longer (for thinner strap) or shorter (for thicker strap)). This requires the operator to partially disassemble the strapping tool, which not only causes downtime but also requires operators to keep the different gates on hand, recognize when a different gate is needed, and properly match the gates to the different strap thicknesses. Using the incorrect gate could result in a failed or suboptimal strapping operation (and in the latter case, suboptimal joint strength).

The gate assembly 1000 of the present disclosure solves this problem by enabling the operator to vary the position of the gate 1010 relative to the linkage 1012 and therefore the height $H_1$ of the strap-receiving opening when the gate 1010 is in its home position. This improves upon prior art strapping tools by enabling the operator to quickly and easily move the gate to accommodate straps of different thicknesses without having to swap out one gate for another.

The second handle assembly 1100 of the strapping tool 50 is movably mounted to the support 300. In this example, the second handle assembly 1100 includes a second handle (not labeled) pivotably mounted to the support 300 by a pivot assembly 1150 shown in FIG. 4. The pivot assembly 1150 includes a pivot-positioning-wheel with radially extending bores along its circumference and a spring-loaded ball assembly. The spring forces the ball into one of the bores to hold the handle in place. An operator can reposition the handle by pivoting the handle with enough force to force the ball to move against the spring force and out of the bore. Continued pivoting of the handle eventually causes the spring to force the ball into another one of the bores. The spring force can be adjusted with a screw plug or other suitable component.

The display assembly 1200 includes a suitable display screen with a touch panel. The display screen is configured to display information regarding the strapping tool (at least in this embodiment), and the touch screen is configured to receive operator inputs. A display controller may control the display screen and the touch panel and, in these embodiments, is communicatively connected to the controller 1300 to send signals to the controller 1300 and to receive signals from the controller 1300.

The controller 1300 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, randomaccess memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping tool 50. The controller 1300 is communicatively and operably connected to the motor 710 and the display assembly 1200 and configured to receive signals from and to control those components. The controller 1300 may also be communicatively connectable (such as via WiFi, Bluetooth, near-field communication, or other suitable wireless communications protocol) to an external device, such as a computing device, to send information to and receive information from that external device.

The power supply 1400 is electrically connected to (via suitable wiring and other components) and configured to power several components of the strapping tool 50, including the motor 710, the display assembly 1200, and the controller 1300. The power supply 1400 is a rechargeable battery (such as a lithium-ion or nickel cadmium battery) in this example embodiment, though it may be any other suitable electric power supply in other embodiments. The power supply 1400 is sized, shaped, and otherwise configured to be received in a receptacle (not labeled) defined by the rear housing portion 120 of the housing 100. The strapping tool includes one or more battery-securing devices (not shown) to releasably lock the power supply 1400 in place upon receipt in the receptacle. Actuation of a release device of the strapping tool 110 or the power supply 1400 unlocks the power supply 1400 from the rear housing portion 120 and enables an operator to remove the power supply 1400 from the rear housing portion 120.

Use of the strapping tool 50 to carry out a strapping cycle including: (1) a tensioning cycle in which the strapping tool 50 tensions a strap S around a load L; and (2) a sealing cycle in which the strapping tool 50 notches both a seal element SE positioned around overlapping top and bottom portions of the strap S and the top and bottom portions of the straps themselves and cuts the strap from the strap supply is described in accordance with FIGS. 16A-16C. Initially: the tensioning assembly 400 is in its strap-tensioning position; the sealing assembly 500 is in its home position; the jaws are in their respective home positions; the object blocker 605 is in its retracted position; the drive wheel 810 is in its home position; the rocker lever 910 is in its home position; and the gate 1010 is in its home position.

Figure 15:
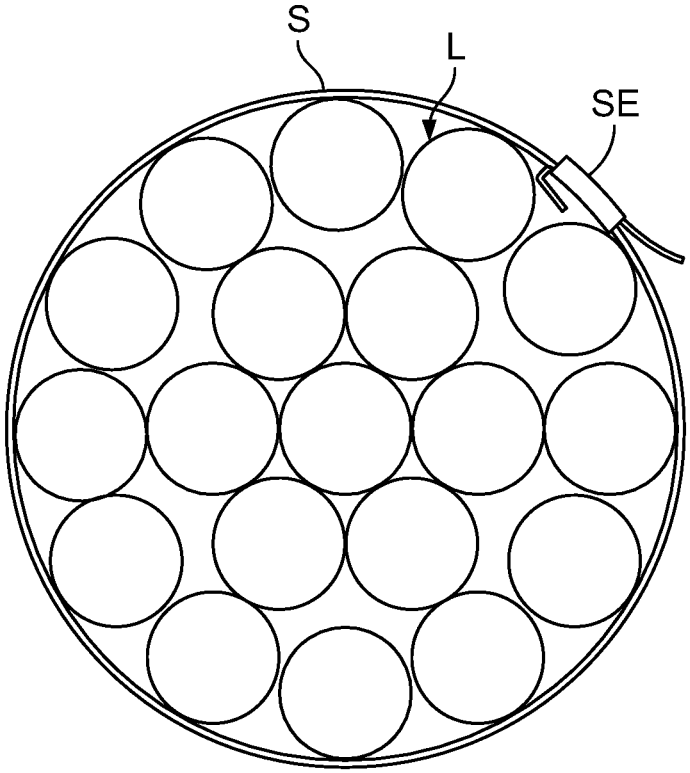
FIG. 15 is a diagrammatic side view of the strap and the seal element positioned around a load before being tensioned and sealed by the strapping tool.

The operator pulls the strap S leading-end first from a strap supply (not shown) and threads the leading end of the strap S through the seal element SE. While holding the seal element SE, the operator wraps the strap around the load L and positions the leading end of the strap S below another portion of the strap S, and again threads the leading end of the strap S through the seal element SE. Afterwards, the seal element SE is positioned around overlapping top and bottom portions of the strap S. The operator then bends the leading end of the strap S backward and slides the seal element SE along the strap S until it meets the bend. FIG. 15 shows the position of the bend and the seal element SE at this point.

The operator then pulls the rocker lever 910 from its home position to its actuated position, which causes the tensioning assembly 400 to move from its strap-tensioning position to its strap-insertion position and the gate 1010 to move from its home position to its strap-insertion position, thereby enlarging the strap-receiving opening to the height $H_2$. The operator then introduces the top portion of the strap S rearward of the seal element SE into the strap-receiving opening so the top portion of the strap S is between the tension wheel 440 and the roller 380 of the foot 320 of the support 300. The operator then manually pulls the strap S to eliminate the slack and pushes the strapping tool 50 toward the seal element SE until the seal element SE engages the gate 1010 and is trapped between the bend in the bottom portion of the strap S and the gate 1010. As shown in FIG. 16A, at this point the seal element SE is below the object blocker 605.

The operator then releases the rocker lever 910, which enables the tensioning-assembly-biasing element to bias the tensioning assembly 400 back to the strap-tensioning position. This causes the tension wheel 440 to engage the top portion of the strap S and pinch it against the roller 380. At this point the bottom portion of the strap S is beneath the foot 320. Movement of the tensioning assembly 400 back to the strap-tensioning position causes the gate 1010 to return to its home position in which the gate 1010 barely contacts or is just above the top portion of the strap.

The operator then actuates an input device (which may be a mechanical pushbutton, which is not shown, or a particular area of the touchscreen of the display assembly 1200 that defines a virtual button) to initiate the strapping cycle. Upon receipt of that operator input, the controller 1300 starts the tensioning cycle by controlling the motor 710 to begin rotating the motor output shaft in the first rotational direction, which causes the tension wheel 440 to begin rotating. As the tension wheel 440 rotates, it pulls on the top portion of the strap S, thereby tensioning the strap S around the load L. Throughout the tensioning cycle, the controller 1300 monitors the current drawn by the motor 710. When this current reaches a preset value that is correlated with the preset tension level set for this strapping cycle, the controller 1300 stops the motor 710, thereby terminating the tensioning cycle. The preset tension level may be set by the operator via an input device of the tool 50.

Figure 17:
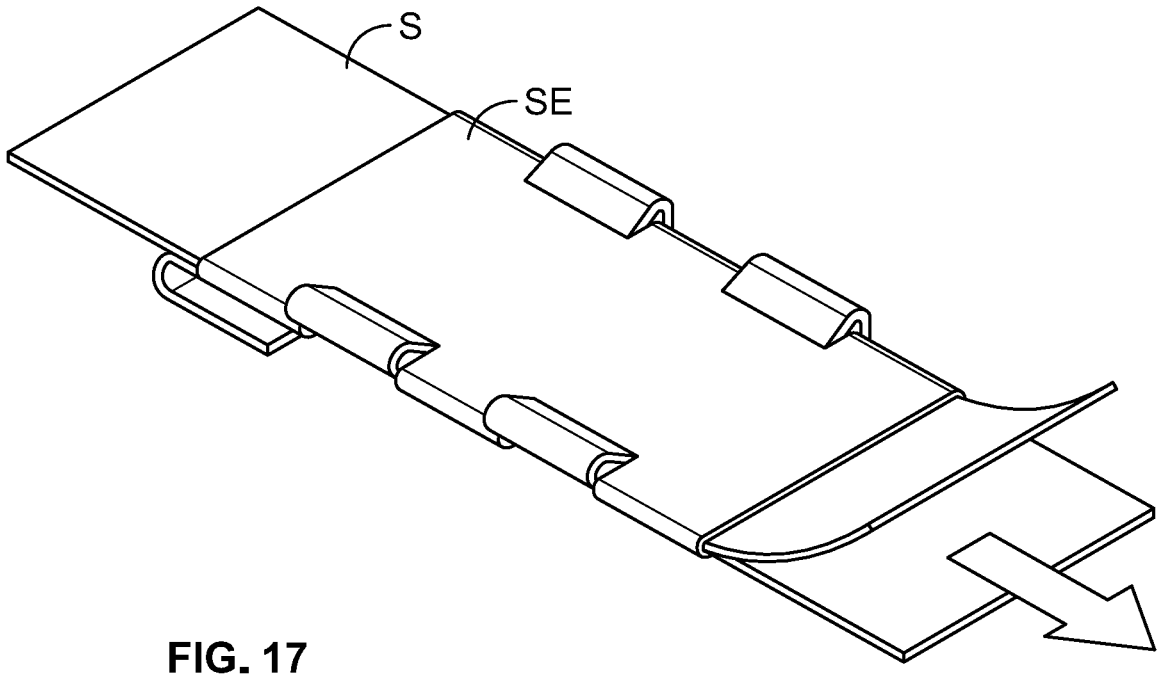
FIG. 17 is a perspective view of the notched seal element.

The controller 1300 then automatically starts the sealing cycle by controlling the motor 710 to begin rotating the motor output shaft in the second rotational direction. As described in detail above, this causes the sealing assembly 500 to move to its sealing position. As the sealing assembly 500 moves to its sealing position, the object-blocker-lift element 630 frees the object blocker 605 to move toward its blocking position. The object blocker 605 contacts the seal element SE and is forced to remain in place by the seal element SE, as shown in FIG. 16B. The sealing assembly 500 is positioned relative to the seal element SE so the seal element SE is within the seal-element-receiving space of the sealing assembly 500 when in its sealing position. After the sealing assembly 500 reaches its sealing position, the jaws: (1) pivot from their respective home positions to their respective sealing positions to cut notches in the seal element SE and the top and bottom portions of the strap S within the seal element SE, as shown in FIG. 16C; and then (2) pivot from their respective sealing positions back to their respective home positions to enable the strapping tool 50 to be removed from the strap S. FIG. 17 shows the notched seal element SE and strap S.

Although the sealing assembly comprises jaws configured to cut into seal elements to attach two portions of the strap to itself, the sealing assembly may comprise other sealing mechanisms in other embodiments, such as a friction-welding assembly or a sealless-attachment assembly.

Other embodiments of the strapping tool may include fewer assemblies than those included in the strapping tool 50 described above and shown in the Figures. For instance, other strapping tools may include only one of the conversion assembly, the object-blocking assembly, and the gate assembly. Further strapping tools may include only two of the conversion assembly, the object-blocking assembly, and the gate assembly. In other words, while the strapping tool 50 includes all three of these assemblies, these assemblies are independent of one another and may be independently included in other strapping tools.

In various embodiments, a strapping tool of the present disclosure comprises a support; a tensioning assembly mounted to the support and movable relative to the support between a tensioning assembly strap-tensioning position and a tensioning assembly strap-insertion position; and a gate movable relative to the support between a gate home position and a gate strap-insertion position. A height of a strap-receiving opening defined between the gate and the support is a first height when the gate is in the gate home position and a second height greater than the first height when the gate is in the gate strap-insertion position. The tensioning assembly is operably connected to the gate so movement of the tensioning assembly from the tensioning assembly strap-tensioning position to the tensioning assembly strap-insertion position causes the gate to move from the gate home position to the gate strap-insertion position.

In certain such embodiments, the gate is mounted to the support.

In certain such embodiments, the support defines a gate-receiving recess in which at least part of the gate is positioned.

In certain such embodiments, the strapping tool further comprises one or more linkages operably connecting the tensioning assembly to the gate.

In certain such embodiments, the one or more linkages comprise a first linkage, a second linkage, and a third linkage. The first linkage is fixedly connected at a first end to the tensioning assembly and pivotably connected at a second end to a first end of the second linkage. A second end of the second linkage is pivotably connected to a first end of the third linkage. A second end of the third linkage is fixedly connected to the gate.

In certain such embodiments, moving the tensioning assembly from the tensioning assembly strap-tensioning position to the tensioning assembly strap-insertion position causes the second linkage to rotate, thereby forcing the gate to move to the gate strap-insertion position.

In certain such embodiments, the tensioning assembly is pivotable relative to the support between the tensioning assembly strap-tensioning position and the tensioning assembly strap-insertion position.

In certain such embodiments, the gate is repositionable relative to the one or more linkages to vary the first height.

In other embodiments, the strapping tool of the present disclosure comprises a support; a sealing assembly mounted to the support, the sealing assembly comprising multiple jaws and an object blocker between the jaws and movable relative to the jaws between an object blocker blocking position and an object blocker retracted position; and a drive assembly operably coupled to the sealing assembly to pivot the jaws from respective jaw home positions to respective jaw sealing positions. The jaws define a seal-element-receiving space therebetween. The object blocker is within the seal-element-receiving space when in the object blocker blocking position. The object blocker is removed from the seal-element-receiving space when in the object blocker retracted position.

In certain such embodiments, the sealing assembly further comprises a biasing element that biases the object blocker to the object blocker blocking position.

In certain such embodiments, the object blocker defines a biasing-element-receiving opening in which at least part of the biasing element is received.

In certain such embodiments, the sealing assembly further comprises a biasing-element retainer that retains the biasing element in the biasing-element-receiving opening.

In certain such embodiments, when the object blocker is in the object blocker blocking position and the jaws move from their jaw home positions to their jaw sealing positions, at least one of the jaws engages the object blocker and drives the object blocker toward the object blocker retracted position.

In certain such embodiments, the sealing assembly further comprises an object-blocker-lift element operably connected to the object blocker and movable relative to the object blocker between a lift element home position and a lift element lifting position. The object blocker is in the object blocker retracted position when the object-blocker-lift element is in the lift element lifting position.

In certain such embodiments, the object blocker is movable between the object blocker retracted and object blocker blocking positions when the object-blocker-lift element is in the lift element home position.

In certain such embodiments, the sealing assembly is movable relative to the support between a sealing assembly home position and a sealing assembly sealing position. The object-blocker-lift element is in the lift element lifting position when the sealing assembly is in the sealing assembly home position. The object-blocker-lift element is biased to the lift element home position when the sealing assembly is in the sealing assembly sealing position.

In certain such embodiments, the sealing assembly further comprises a biasing element that biases the object blocker to the object blocker blocking position and the object-blocker-lift element to the lift element home position.

In certain such embodiments, the sealing assembly is mounted to the support by a sealing assembly mounting element. The sealing assembly comprises a cover comprising a lip. The object-blocker-lift element comprises a camming surface. The camming surface engages the lip so the object-blocker lift element is constrained between the lip and the sealing assembly mounting element.

In certain such embodiments, the sealing assembly further comprises a central jaw connector. The jaws comprise a first pair of jaws and a second pair of jaws. The jaws of the first and second pairs of jaws are pivotably mounted to the central jaw connector. The central jaw connector is positioned between the first and second pairs of jaws.

In certain such embodiments, the object blocker is movably mounted to the central jaw connector.

Other embodiments of the strapping tool of the present disclosure comprise a support; a sealing assembly mounted to the support and movable relative to the support between a sealing assembly home position and a sealing assembly sealing position, the sealing assembly comprising multiple jaws pivotable from respective jaw home positions to respective jaw sealing positions, a conversion assembly comprising a linkage operably connected to the sealing assembly and configured to move the sealing assembly between the sealing assembly home position and the sealing assembly sealing position and configured to move the jaws between their jaw home positions and their jaw sealing positions, wherein the conversion assembly is configured to change an effective length of the linkage while moving the sealing assembly from the sealing assembly home position and the sealing assembly sealing position; and a drive assembly operably connected to the conversion assembly and configured to drive the linkage.

In certain such embodiments, the conversion assembly further comprises a drive wheel comprising a drive shaft radially spaced from a rotational axis of the drive wheel. The drive assembly is operably connected to the drive wheel and configured to rotate the drive wheel. The linkage is mounted to the drive shaft.

In certain such embodiments, the conversion assembly further comprises a linkage mount mounted to and rotatable relative to the drive shaft. The linkage is mounted to and rotatable relative to the linkage mount.

In certain such embodiments, the effective length of the linkage is a minimum effective length when the linkage mount is in a first rotational position relative to the linkage and a maximum effective length when the linkage mount is in a second different rotational position relative to the linkage.

In certain such embodiments, the linkage mount further comprises first and second fingers. The conversion assembly further comprises an effective-length-changing device fixed relative to the drive wheel, the linkage, and the linkage mount. The effective-length-changing device comprises first and second stationary fingers.

In certain such embodiments, the effective-length-changing device is mounted to the support.

In certain such embodiments, the first and second stationary fingers are positioned such that, during rotation of the drive wheel from a drive wheel home position to a drive wheel sealing position, the second finger engages the second stationary finger and causes the linkage mount to rotate relative to the linkage to increase the effective length of the linkage.

In certain such embodiments, the first and second stationary fingers are positioned such that, during rotation of the drive wheel from the drive wheel sealing position to the drive wheel home position, the first finger engages the first stationary finger and causes the linkage mount to rotate relative to the linkage to decrease the effective length of the linkage.

In certain such embodiments, the sealing assembly is in the sealing assembly home position and the jaws are in the jaw home positions when the effective length of the linkage is the minimum effective length.

In certain such embodiments, the sealing assembly is in the sealing assembly sealing position and the jaws are in the jaw sealing positions when the effective length of the linkage is the maximum effective length.

The invention claimed is:

1. A strapping tool comprising:

a support;

a sealing assembly mounted to the support and movable via translatory motion relative to the support between a sealing assembly home position and a sealing assembly sealing position, the sealing assembly comprising a cover and multiple jaws connected to the cover and pivotable relative to the cover from respective jaw home positions to respective jaw sealing positions in addition to the sealing assembly being movable via translatory motion between the sealing assembly home and sealing positions;

a conversion assembly comprising a linkage operably connected to the sealing assembly and configured to move the sealing assembly via translatory motion between the sealing assembly home position and the sealing assembly sealing position and configured to pivot the jaws between their jaw home positions and their jaw sealing positions, wherein the conversion assembly is configured to change an effective length of the linkage while moving the sealing assembly via translatory motion from the sealing assembly home position to the sealing assembly sealing position; and a drive assembly operably connected to the conversion assembly and configured to drive the linkage.

2. The strapping tool of claim 1, wherein the conversion assembly further comprises a drive wheel comprising a drive shaft radially spaced from a rotational axis of the drive wheel, wherein the drive assembly is operably connected to the drive wheel and configured to rotate the drive wheel, wherein the linkage is mounted to the drive shaft.

3. The strapping tool of claim 2, wherein the conversion assembly further comprises a linkage mount mounted to and rotatable relative to the drive shaft, wherein the linkage is mounted to and rotatable relative to the linkage mount.

4. The strapping tool of claim 3, wherein the effective length of the linkage is a minimum effective length when the linkage mount is in a first rotational position relative to the linkage and a maximum effective length when the linkage mount is in a second different rotational position relative to the linkage.

5. The strapping tool of claim 4, wherein the linkage mount further comprises first and second fingers, wherein the conversion assembly further comprises an effective-length-changing device fixed relative to the drive wheel, the linkage, and the linkage mount, wherein the effective-length-changing device comprises first and second stationary fingers.

6. The strapping tool of claim 5, wherein the effective-length-changing device is mounted to the support.

7. The strapping tool of claim 5, wherein the first and second stationary fingers are positioned such that, during rotation of the drive wheel from a drive wheel home position to a drive wheel sealing position, the second finger engages the second stationary finger and causes the linkage mount to rotate relative to the linkage to increase the effective length of the linkage.

8. The strapping tool of claim 7, wherein the first and second stationary fingers are positioned such that, during rotation of the drive wheel from the drive wheel sealing position to the drive wheel home position, the first finger engages the first stationary finger and causes the linkage mount to rotate relative to the linkage to decrease the effective length of the linkage.

9. The strapping tool of claim 4, wherein the sealing assembly is in the sealing assembly home position and the jaws are in the jaw home positions when the effective length of the linkage is the minimum effective length.

10. The strapping tool of claim 9, wherein the sealing assembly is in the sealing assembly sealing position and the jaws are in the jaw sealing positions when the effective length of the linkage is the maximum effective length.

11. The strapping tool of claim 1, wherein the linkage is operably connected to the sealing assembly and configured to move the sealing assembly via translatory motion from the sealing assembly home position to the sealing assembly sealing position before pivoting the jaws from their jaw home positions to their jaw sealing positions.

12. The strapping tool of claim 11, wherein the linkage is operably connected to the sealing assembly and configured to pivot the jaws from their jaw sealing positions back to their jaw home positions before moving the sealing assembly via translatory motion from the sealing assembly sealing position back to the sealing assembly home position.

13. A strapping tool comprising:

a support;

a sealing assembly mounted to the support and movable relative to the support between a sealing assembly home position and a sealing assembly sealing position, the sealing assembly comprising multiple jaws pivotable from respective jaw home positions to respective jaw sealing positions;

a conversion assembly comprising:

a drive wheel comprising a drive shaft radially spaced from a rotational axis of the drive wheel;

a linkage mount mounted to and rotatable relative to the drive shaft and comprising first and second fingers;

a linkage mounted to and rotatable relative to the linkage mount and operably connected to the sealing assembly, wherein the linkage is configured to move the sealing assembly between the sealing assembly home position and the sealing assembly sealing position and is configured to move the jaws between their jaw home positions and their jaw sealing positions; and an effective-length-changing device fixed relative to the drive wheel, the linkage, and the linkage mount, wherein the effective-length-changing device comprises first and second stationary fingers;

wherein the conversion assembly is configured to change an effective length of the linkage while moving the sealing assembly from the sealing assembly home position to the sealing assembly sealing position, wherein the effective length of the linkage is a minimum effective length when the linkage mount is in a first rotational position relative to the linkage and a maximum effective length when the linkage mount is in a second different rotational position relative to the linkage; and a drive assembly operably connected to the drive wheel and configured to rotate the drive wheel to drive the linkage.

14. The strapping tool of claim 13, wherein the effective-length-changing device is mounted to the support.

15. The strapping tool of claim 13, wherein the first and second stationary fingers are positioned such that, during rotation of the drive wheel from a drive wheel home position to a drive wheel sealing position, the second finger engages the second stationary finger and causes the linkage mount to rotate relative to the linkage to increase the effective length of the linkage.

16. The strapping tool of claim 15, wherein the first and second stationary fingers are positioned such that, during rotation of the drive wheel from the drive wheel sealing position to the drive wheel home position, the first finger engages the first stationary finger and causes the linkage mount to rotate relative to the linkage to decrease the effective length of the linkage.

* * * * *